US006725612B2

(12) United States Patent
Kim

(10) Patent No.: US 6,725,612 B2
(45) Date of Patent: Apr. 27, 2004

(54) DIRECTIONAL ROLLING PENDULUM SEISMIC ISOLATION SYSTEMS AND ROLLER ASSEMBLY THEREFOR

(76) Inventor: Jae Kwan Kim, Daelim Apartment 6-109, Jamwon-dong, Seocho-ku, Seoul 137-947 (KR)

( * ) Notice: Subject to any disclaimer, the term of this patent is extended or adjusted under 35 U.S.C. 154(b) by 57 days.

(21) Appl. No.: 10/096,220

(22) Filed: Mar. 11, 2002

(65) Prior Publication Data

US 2002/0166296 A1 Nov. 14, 2002

(30) Foreign Application Priority Data

May 4, 2001 (KR) ..... 2001-24413

(51) Int. Cl.[7] ..... E04H 9/02; E04B 1/98
(52) U.S. Cl. ..... 52/167.5; 52/167.1
(58) Field of Search ..... 52/167.1, 167.4, 52/167.5

(56) References Cited

U.S. PATENT DOCUMENTS 3,212,745 A * 10/1965 Lode ..... 248/580
5,466,068 A * 11/1995 Andra et al. ..... 384/36
5,934,029 A * 8/1999 Kawai et al. ..... 52/167.5
6,092,780 A * 7/2000 Kurabayashi et al. ..... 248/636
6,123,313 A * 9/2000 Otsuka et al. ..... 248/580
6,164,022 A * 12/2000 Ishikawa et al. ..... 52/167.5
6,505,806 B1 * 1/2003 Glaesener ..... 248/638

FOREIGN PATENT DOCUMENTS

JP 03169984 A * 7/1991 ..... E04H/9/02

* cited by examiner

*Primary Examiner*—Brian E. Glessner
(74) *Attorney, Agent, or Firm*—Head, Johnson & Kachigian

(57) ABSTRACT

A bi-directional rolling pendulum seismic isolation system for reducing seismic force acting on a structure by rolling pendulum movements, the system having a lower plate forming a rolling path in a first direction; an upper plate forming a rolling path in a second direction; and a roller assembly performing a pendulum motion by rolling and moving along the lower and upper plates wherein the roller assembly performs the pendulum motion when seismic load is applied, thereby reducing the seismic load of a structure.

7 Claims, 37 Drawing Sheets

DIRECTIONAL ROLLING PENDULUM SEISMIC ISOLATION SYSTEMS AND ROLLER ASSEMBLY THEREFOR

CROSS-REFERENCE TO RELATED APPLICATION

This application claims priority to South Korean Application No. 2001-24413 filed May 4, 2001.

BACKGROUND OF THE INVENTION

1. Field of the Invention

The present invention relates to directional rolling pendulum seismic isolation systems and roller assembly therefor, and more particularly, to directional rolling pendulum seismic isolation systems and roller assembly therefor, that can reduce seismic load applied to structures, such as bridges, general buildings, precision machines or cultural assets.

2. Description of the Related Art

In traditional earthquake resistant design of structures, the structural members, components and systems are required to have adequate amount strength and ductility in the event of strong earthquakes. However, the structures designed according to this strength design principle tend to experience severe damage or excessive deformation in the event of very strong earthquake even though they may not collapse. Therefore alternative methods have been developed that can protect structures from earthquakes within predetermined deformation limit. One of the most widely used protection methods is seismic isolation system. Because it has been proved to be very effective in the reduction of seismic load in recent earthquakes, the use of seismic isolation systems is on an increasing trend.

A Korean patent application No. 2000-37760 discloses a basic principle of the seismic isolation systems. The above basic principle will be explained again in the following.

If a structure 201 is fixed to the ground 202 as shown in FIG. 1*a*, it can be modeled as a single degree of freedom system as shown in FIG. 1*b*. The response of the structure to the earthquake action, such as base shear force and relative displacement can be estimated using response spectra.

FIGS. 2*a* and 2*b* show graphs of acceleration response spectra and graphs of displacement response spectra respectively as examples. The drawings show response spectra for two values of damping ratio. In the graph of FIG. 2*a*, the vertical axis indicates the spectral acceleration and the horizontal axis indicates the period. In the graph of FIG. 2*b*, the vertical axis indicates the spectral displacement and the horizontal axis indicates the period. The base shear force acting between the structure and the ground by the horizontal ground motion can be estimated from the acceleration response spectrum shown in FIG. 2*a*. That is, if the natural period and the damping ratio ($\xi_1$ or $\xi_2$) of the single degree of freedom are given, the spectral acceleration is read from the curves shown in FIG. 2*a*. If the obtained spectral acceleration value is multiplied by the mass of the structure, the base shear force is approximately found.

The relative displacement between the superstructure and the ground can be estimated from the displacement response spectrum shown in FIG. 2*b*. If the natural period of the single degree of freedom and the damping ratio are given, the spectral displacement is read from the curves shown in FIG. 2*b*. The obtained spectral displacement shows the displacement of the single degree of freedom relative to the ground.

As can be seen from the graph shown in FIG. 2*a*, generally, if the period becomes longer, the spectral acceleration is reduced. Moreover, in the same period, if the damping ratio becomes larger, the value of the spectral acceleration is reduced.

In the case of the spectral displacement, as can be seen from the graph shown in FIG. 2*b*, if the period becomes longer, the relative displacement is increased. Furthermore, in the same period, if the damping ratio becomes larger, the value of the spectral displacement is reduced.

In conclusion, if the period is longer and the damping ratio is higher, the spectral acceleration is reduced, and thereby the seismic force, i.e., floor shear force, becomes small. The seismic isolation systems adopt the above mechanical principle. For example, the seismic isolation system such as a high damping lead rubber bearing has mechanical properties that the horizontal stiffness is very small but the damping capacity is high.

As shown in FIG. 3*a*, if a seismic isolation system 203 is installed between the base frame and a ground 202, the natural period of the whole structural system becomes even longer, and also the damping ratio increases. Like this, if the natural period T becomes longer period $T_e$ or the damping ratio $\xi$ is increased to a ratio $\xi_e$ then the seismic force can be reduced significantly, as can be seen from the graph shown in FIG. 3*b*.

However, as shown in FIG. 3*c*, if the natural period becomes longer, the relative displacement increases. To restrict the increase of the relative displacement, dampers can be installed in addition to the conventional seismic isolation system having low damping capacity. One of the seismic isolation systems having high damping capacity and the long natural period, which do not require the additional dampers, is a sliding pendulum seismic isolation system. However, the sliding pendulum seismic isolation system used presently has a structure that a slider moves on a dish having a concave surface, and therefore if the seismic isolating period becomes longer, the diameter of the dish becomes even larger. In the case of bridges, generally, an area to install a seismic isolator on a pier or an abutment is extremely restricted.

It is required to lengthen a seismic isolating period and maintain a low friction coefficient in structures, which may be easily damaged even by a low seismic load, such as precision machines or cultural assets. However, it is difficult to lengthen the seismic isolating period sufficiently if a general lead rubber bearing is used because the precision machines or the cultural assets are lower in weight than general structures. Otherwise, in the case of conventional pendulum seismic isolation systems, it is possible to lengthen the seismic isolating period, but it is difficult to maintain the friction coefficient in a low condition. Furthermore, the conventional pendulum seismic isolation systems have another problem that the sliding surface must have a larger diameter if the period is lengthened. The conventional pendulum seismic isolation systems utilizes measures such as injecting lubricating oil into the surface of a friction plate or applying special coating to the sliding surface to lower the friction coefficient. Therefore, to protect the structures, which are light in weight and may be easily damaged even by the low seismic load, such as precision machines or cultural assets, from a seismic tremor, a new type of seismic isolation systems, which can lengthen the seismic isolating period and maintain the friction coefficient in the low condition in an easy and stable manner, has been required.

SUMMARY OF THE INVENTION

It is, therefore, an object of the present invention to provide a pendulum seismic isolation system having a new configuration, which can be easily installed without limitations in an installation area.

It is a another object of the present invention to provide a pendulum seismic isolation system, which moves in predetermined directions and yet effectively induces seismic isolation effects in all horizontal directions for the earthquake motion that is applied in arbitrary direction.

It is a further object of the present invention to provide a pendulum seismic isolation systems suitable for structures, which may be easily damaged even by a low seismic load, such as precision machines, cultural assets and buildings requiring a long seismic isolating period to isolate seismic force in a restricted space while having advantages of the conventional pendulum seismic isolation systems.

To achieve the above objects, the present invention provides a directional rolling pendulum seismic isolation system, which reduces earthquake effects on the structures using pendulum motion in selected directions.

The present invention provides bi-directional rolling pendulum seismic isolation systems for reducing seismic force acting on a structure by rolling pendulum movements, each system comprising a lower plate forming a rolling path in a first direction; an upper plate forming a rolling path in a second direction; and a roller assembly performing a pendulum motion by rolling and moving along the lower and upper plates; wherein the roller assembly performs the pendulum motion when seismic load is applied, thereby reducing the seismic load of a structure.

According to the embodiment of the present invention, the upper and lower plates have upper and lower channels, on which the roller assembly rolls and moves, respectively, and the roller assembly includes a main body, a plurality of lower rollers mounted on a lower portion of the main body, the lower rollers rolling and moving along the lower channel of the lower plate, and a plurality of upper rollers mounted on an upper portion of the main body, the upper rollers rolling and moving along the upper channel of the upper plate.

Further, in another embodiment of the present invention, the roller assembly includes a lower main body on which a plurality of lower rollers are mounted on a lower portion thereof and an upper main body on which a plurality of upper rollers are mounted on an upper portion thereof, the lower rollers rolling and moving along the lower channel of the lower plate, the upper rollers rolling and moving along the upper channel of the upper plate, and elastic or elasto-plastic objects being inserted between the upper main body and the lower main body. Thus, the roller assembly is manufactured in a separable type.

In the above embodiment, preferably, the elastic or elasto-plastic objects of the separable roller assembly are spheres, which have a prescribed elasticity and damping property, and the upper and lower main bodies respectively have hemispherical holes for inserting the elastic or elasto-plastic objects.

Further, in the above embodiment, preferably, the upper main body and the lower main body are able to rotate with respect to a vertical axis. Especially, the elastic or elasto-plastic objects of the separable roller assembly may be spheres, which have a prescribed elasticity and damping property, and the upper and lower main bodies respectively may have central hemispherical holes for inserting the elastic or elasto-plastic objects and outer holes formed around the central holes.

Otherwise, the upper and lower main bodies respectively may have central hemispherical holes and outer holes formed around the central holes, and the elastic or elasto-plastic objects of the sphere type, which have a prescribed elasticity and damping property, may be inserted into the central holes. Further, the elastic or elasto-plastic objects of a doughnut type, which have a prescribed elasticity and damping property, may be inserted into the outer holes.

In another embodiment, the elastic or elasto-plastic objects of the separable roller assembly may be spheres, which have a prescribed elasticity and damping property, and the upper and lower main bodies respectively may have holes for inserting the elastic or elasto-plastic objects of a disc type.

Further, in another embodiment, preferably, an intermediate main body may be inserted between the upper main body and the lower main body, and the upper main body and the lower main body are rotated relative to the intermediate main body in a horizontal direction respectively. Thus, the systems are manufactured in an articulated type.

According to another embodiment of the present invention, the roller assembly has a prescribed ratio of breath/height (B/H) to prevent an overturn when performing the pendulum motion, and a radius of curvature ($r_L$) of a circular section of the upper channel is smaller than that of the first directional pendulum motion to prevent the upper rollers from being separated from the upper channel while the roller assembly performs the pendulum motion in the lower channel. Further, a radius of curvature ($r_T$) of a circular section of the lower channel is smaller than that of the second directional pendulum motion to prevent the lower rollers from being separated from the lower channel while the roller assembly performs the pendulum motion in the upper channel, and thereby performing a stable seismic isolation function without overturn or separation from the lower channel or the upper channel while the roller assembly performs the bi-directional pendulum motion.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

The present invention will now be described in detail in connection with preferred embodiments with reference to the accompanying drawings.

Figure 5:
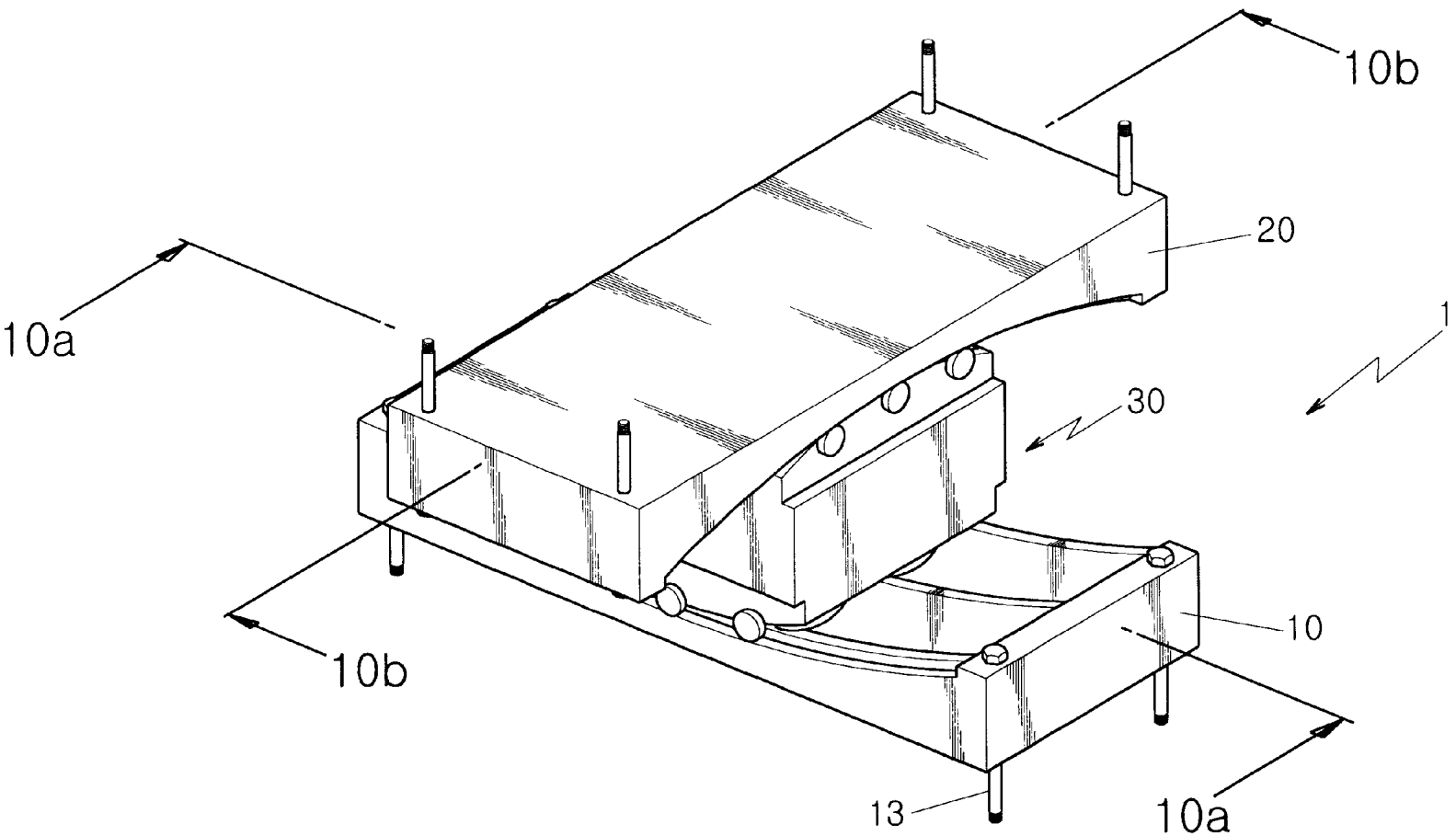
FIG. 5 is a perspective view of a bi-directional rolling pendulum seismic isolation system having two-channel plate according to the present invention.

FIG. 5 shows a schematically perspective view of an embodiment of bi-directional rolling pendulum seismic isolation systems according to the present invention.

As shown in FIG. 5, the bi-directional rolling pendulum seismic isolation system 1 according to the present invention includes a lower plate 10 forming a rolling path in the first direction, an upper plate 20 forming a rolling path in the second direction, and a roller assembly 30 rolling in the two directions and performing the pendulum motion between the lower plate 10 and the upper plate 20.

Figure 6A:
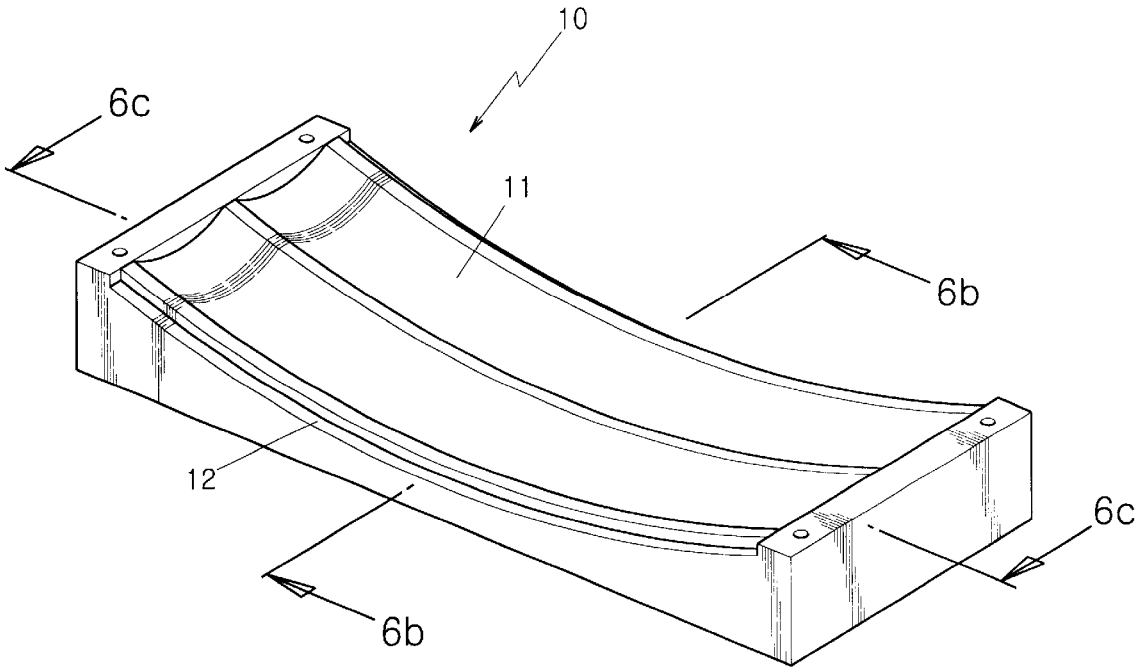
FIGS. 6*a* through 6*c* are schematically perspective views of two-channel plate of the bi-directional rolling pendulum seismic isolation system according to the present invention.
Figure 6B:
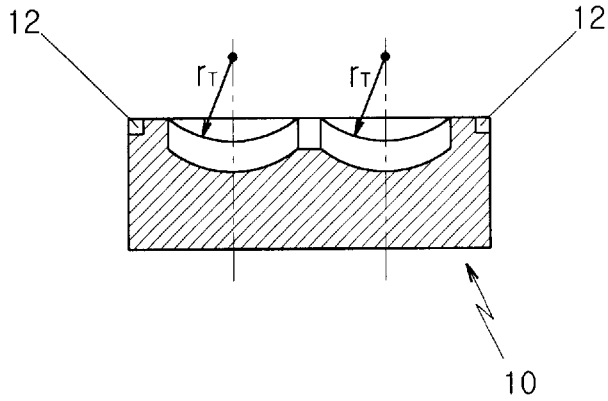
Figure 6C:
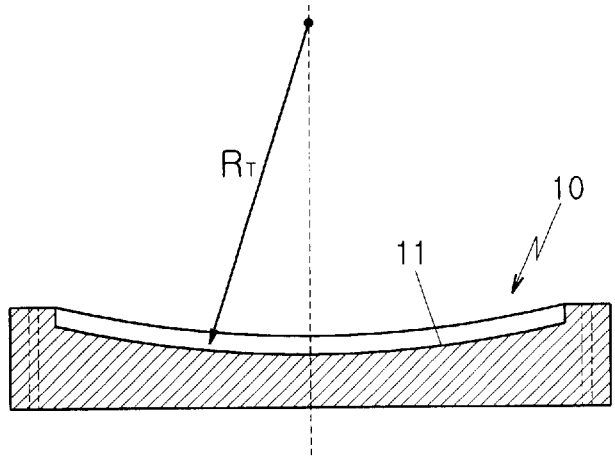

FIGS. 6*a* through 6*c* show the lower plate 10 in more detail. FIG. 6*a* is a perspective view of the lower plate 10, and FIGS. 6*b* and 6*c* are views taken along the lines C—C and D—D in FIG. 6*a*. As shown in FIG. 6*a*, the lower plate 10 has lower rolling channels 11 for allowing the roller assembly 30 to roll. As shown in FIG. 6*b* and FIG. 6*c*, the lower channel 11 is in the form of a concave arc section of a predetermined radius of curvature ($r_T$) and is in the form of an arc of a predetermined radius of curvature ($R_T$) in a longitudinal direction, i.e., the first direction. The radius of curvature ($r_T$) of the arc section has a value even smaller than the radius of curvature ($R_T$) of the pendulum motion. In FIG. 5, the reference numeral 13 indicates coupling means 13, such as a bolt, for fixing the lower plate 10 to the structure. To prevent the roller assembly 30 from being separated from the lower channel 11 relative to a horizontal motion of a certain direction, auxiliary drums 42 are provided at right and left sides of the lower channel 11 and the auxiliary channel 12 opened to the outside may be formed along the lower channel 11.

In the bi-directional rolling pendulum seismic isolation system 1 of the present invention, in the same way as the lower plate 10, the upper plate 20 is also in the form of a concave arc section of a predetermined radius of curvature ($r_L$) and is in the form of an arc of a predetermined radius of curvature ($R_L$) in a longitudinal direction (the second direction). The upper plate 20 has a pair of parallel upper channels 21, on which the roller assembly 30 rolls. In the same way as the lower plate 10, the upper plate 20 may also have two or more channels. To prevent the roller assembly 30 from being separated from the lower channel 21 relative to a horizontal motion of a certain direction, auxiliary drums 52 are provided at right and left sides of the lower channel 21 and the auxiliary channel 22 opened to the outside may be formed along the lower channel 21.

It is preferable that the friction plate is made of metal materials, which can be easily processed without getting rusty and have excellent mechanical characteristics such as a thermal expansion coefficient, rigidity, hardness and abrasion resistance, but it is not restricted to the above.

Figure 7A:
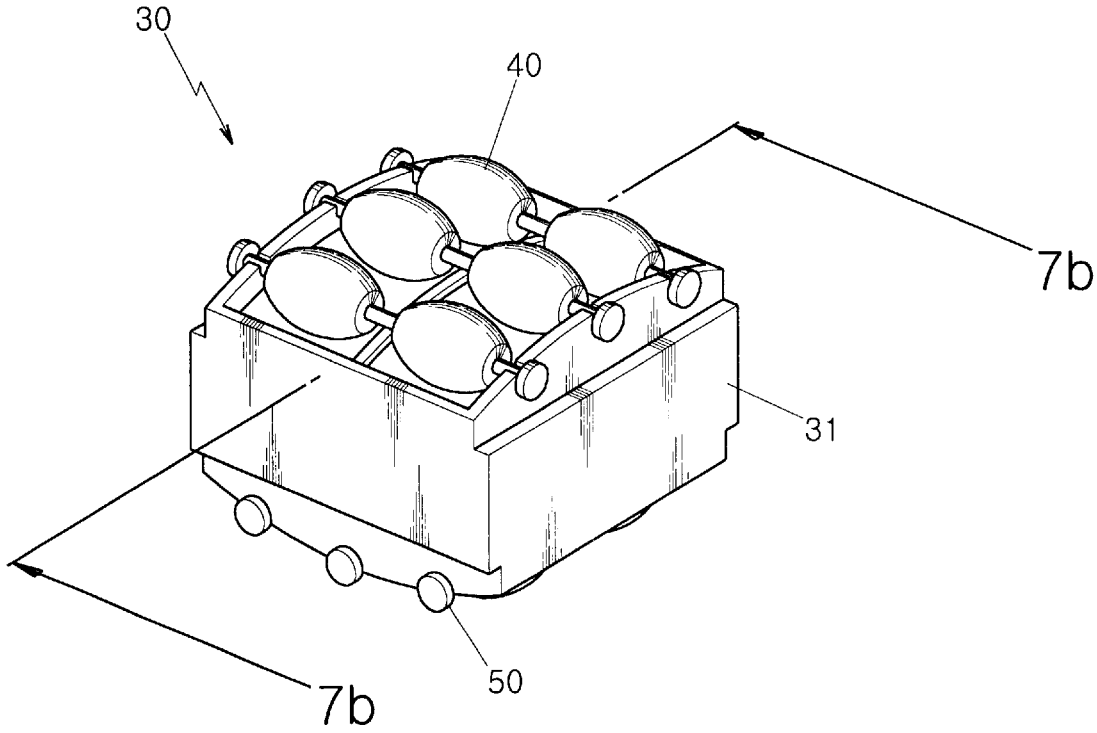
FIGS. 7*a* through 7*c* are perspective views and a sectional view of a roller assembly provided on the bi-directional rolling pendulum seismic isolation system having two-channel plate.
Figure 7B:
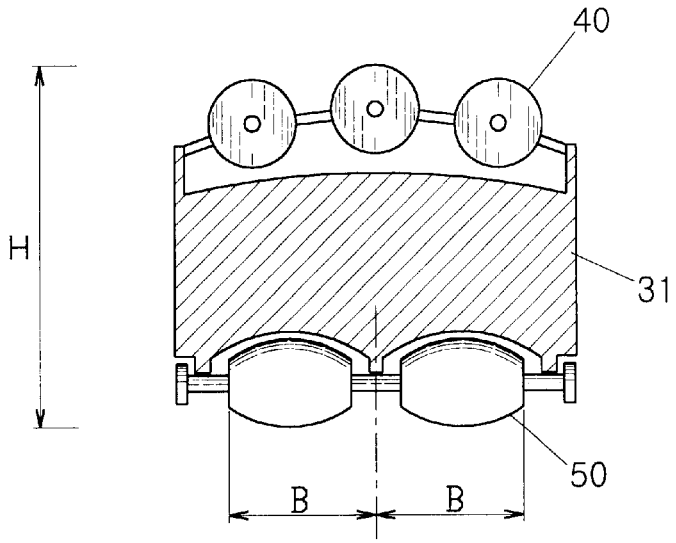

The roller assembly 30, which rolls along the lower and the upper channels 11, 21 is mounted between the lower plate 10 and the upper plate 20. FIGS. 7*a* though 7*c* illustrate a brief perspective view of a preferred embodiment of a un-separable rectangular roller assembly 30 having two-channel friction plates, a sectional view of FIG. 7*a* taken along the line 7*b*–7*b* and a perspective view of a main body 31, from which rollers are omitted. As shown in FIG. 7*a*, the roller assembly 30 includes the main body 31 and upper and lower rollers 40 and 50. A prescribed number of the upper rollers 40 (thee upper rollers in this embodiment), which roll and rotate within the upper plate, are arranged side by side on an upper portion of the main body 31. A prescribed number of the lower rollers 50 (three If a distance (B) from the center of the roller assembly 30 to the center of the drum 41 and a ratio (B/H) of a height (H) of the roller assembly 30 defined in FIG. 7*b* are larger than the friction coefficient of the rollers, a stability to the overturning can be maintained when the roller assembly 30 moves along the channel and performs the pendulum motion.

Figure 7C:
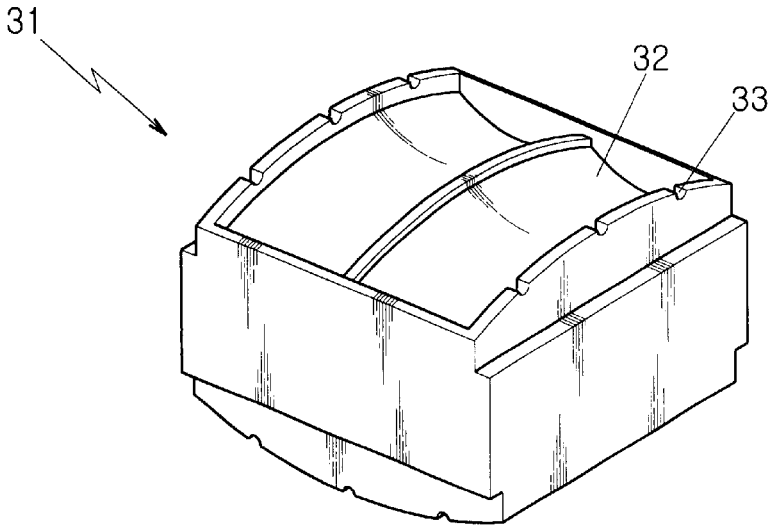

FIG. 7*c* illustrates the main body 31 that the rollers 40 and 50 are separated from the roller assembly 30. The main body 31 includes a channel 32 provided on an upper portion of the main body 31 to insert the upper rollers 40 and holes 33 formed at upper surfaces of both channel walls to insert roller shafts 43. The main body 31 includes a channel and holes, which have the same form as the upper channel 32 and holes 33, on a lower portion of the main body 31 in a rectangular direction to the upper portion. The rollers 40 and 50 transmit load to the main body 31 through the roller shafts 43 without a direct contact with the main body 31 and can freely rotate within the channel 32 of the main body 31. The rollers 40 and 50 inside the main body 31 are arranged in the form of a curve having a prescribed curvature in an advancing direction of the main body 31. By the curved arrangement of the rollers 40 and 50, the rollers 40 and 50 and the friction plates 10 and 20 can be in a smooth contact to each other when the roller assembly 30 performs a pendulum motion along the upper and lower plates 10 and 20. Moreover, in the case of a main body of a separable roller assembly, which will be described later, the vertical load can be shared by the rollers 40 and 50 and the rollers 40 and 50 can move smoothly because the rollers 40 and 50 can simultaneously contact with the channel 32.

Figure 8:
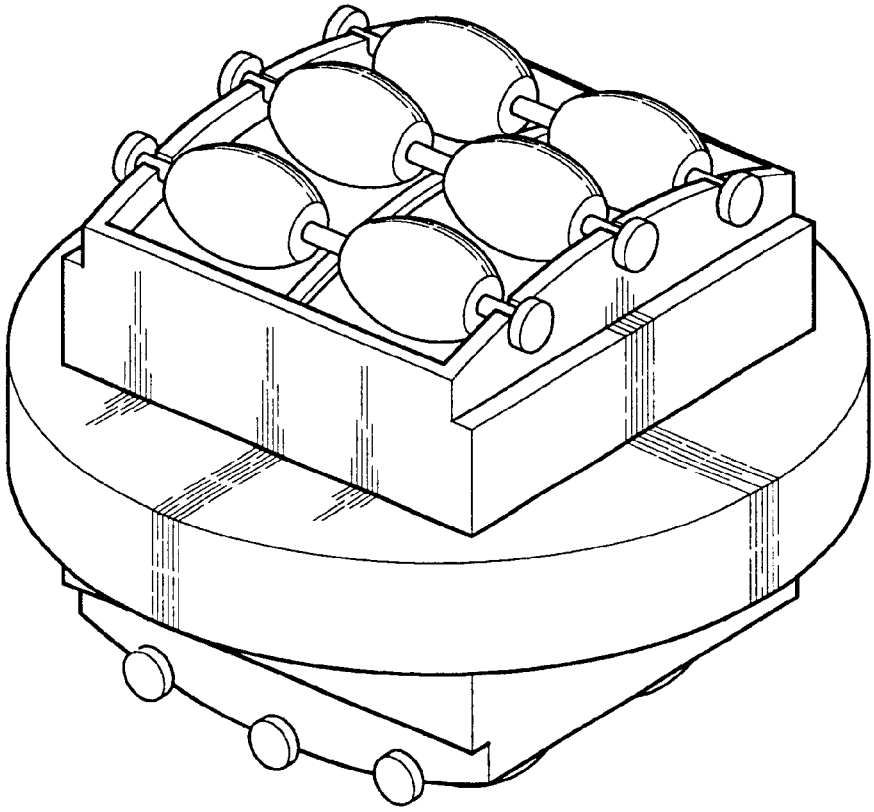
FIG. 8 is a perspective view of an integrated circular supporting structure provided on the bi-directional rolling pendulum seismic isolation system having two-channel plate.

The main body 31 is not restricted to the rectangular form, but may be in the form of a disc as shown in FIG. 8 or in the form of a parallelogram if inclined angles of two axial directions are not at right angles to each other. A modification of the roller assembly 30 will be described later.

Figure 9A:
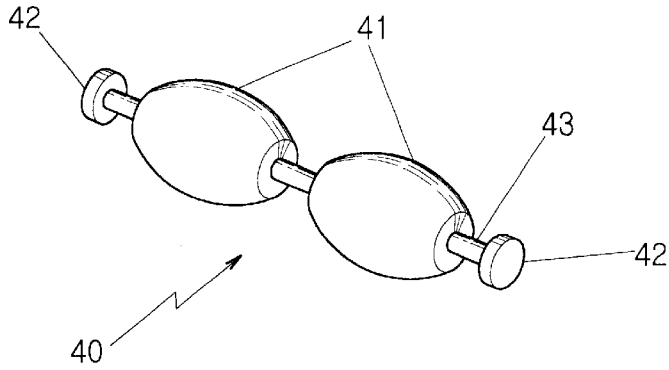
FIGS. 9*a* through 9*c* are a perspective view and sectional views of two-drum roller for the two-channel plate.
Figure 9B:
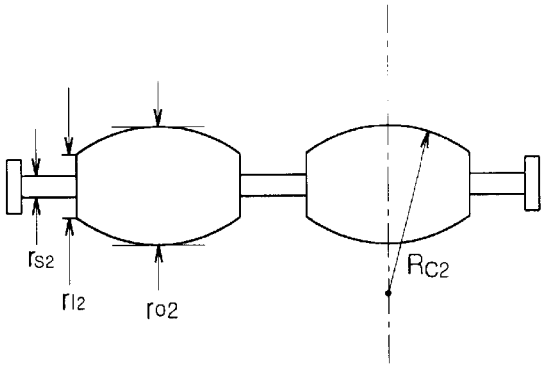

Also, the rollers 40 rolling in contact with the channel may have various forms according to structures of the roller assembly 30 and the upper and lower plates 10 and 20. FIG. 9*a* illustrates a perspective view of a preferred embodiment of the rollers 40 coupled with the two-channel friction plates. The roller 40 has two drums 41 located at the center thereof in a prescribed interval and in a direction of the roller shaft 43. The roller 40 may have auxiliary drums 42 at both ends of the roller shaft 43. The auxiliary drums 42 can prevent the rollers 40 from being separated from the friction plates when the roller assembly 30 performs the pendulum motion. In FIG. 9*b*, $r_{S2}$ is a radius of the shaft, $r_{I2}$ is an inner radius of the drum 41, and $r_{02}$ is an outer radius of the drum 41. The friction coefficient of the roller 40 can be controlled by a ratio ($r_{I2}/r_{S2}$) or ($r_{02}/r_{S2}$) of the radiuses of the drum 41 and the shaft. $R_{C2}$ is a radius of axial curvature of the drum. If $R_{C2}$ has an infinite value, the drum becomes a straight line in an axial direction and a cylindrical form. The drum 41 and the roller shaft 43 may be manufactured integrally or coupled after manufactured separately. The drum 41 and the roller shaft 43 may be made of the same material or different materials.

Figure 9C:
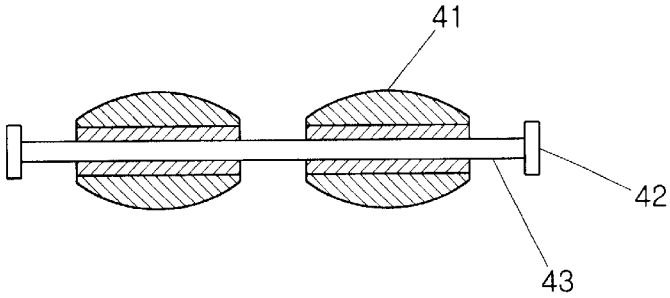

It is preferable that the surface of the shaft contacting with the surface of the drum 41 and the main body 31 is coated with the material having favorable friction characteristics, durability, abrasion resistance and heat resistance. The drum 41 may be manufactured in multi layers as shown in FIG. 9*c*. The drum 41 and the roller shaft 43 may be manufactured integrally to move together, or manufactured to slide.

Next, a coupled relationship between the upper and lower plates 10 and 20 and the roller assembly 30 will be described.

Figure 10A:
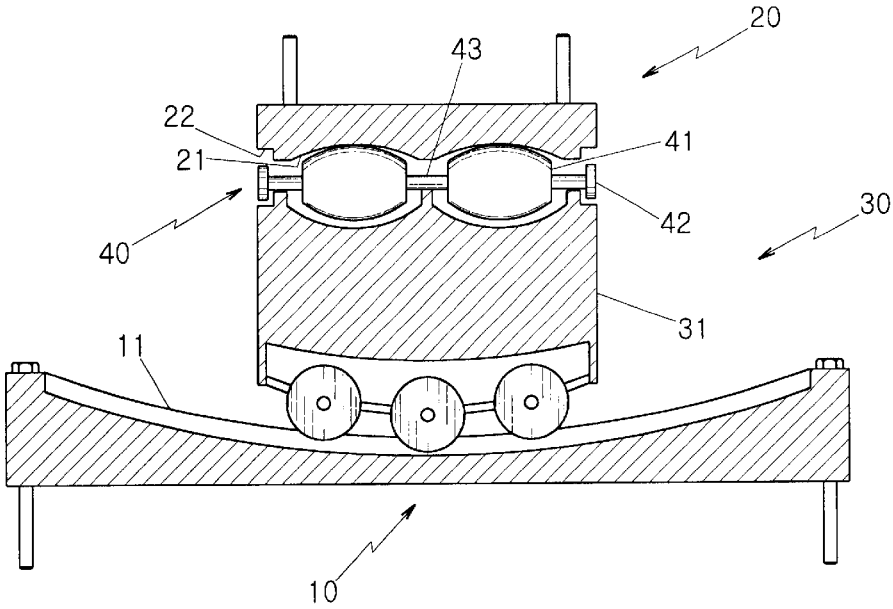
FIGS. 10*a* and 10*b* are sectional views of the bi-directional rolling pendulum seismic isolation system having two-channel plate according to the present invention.
Figure 10B:
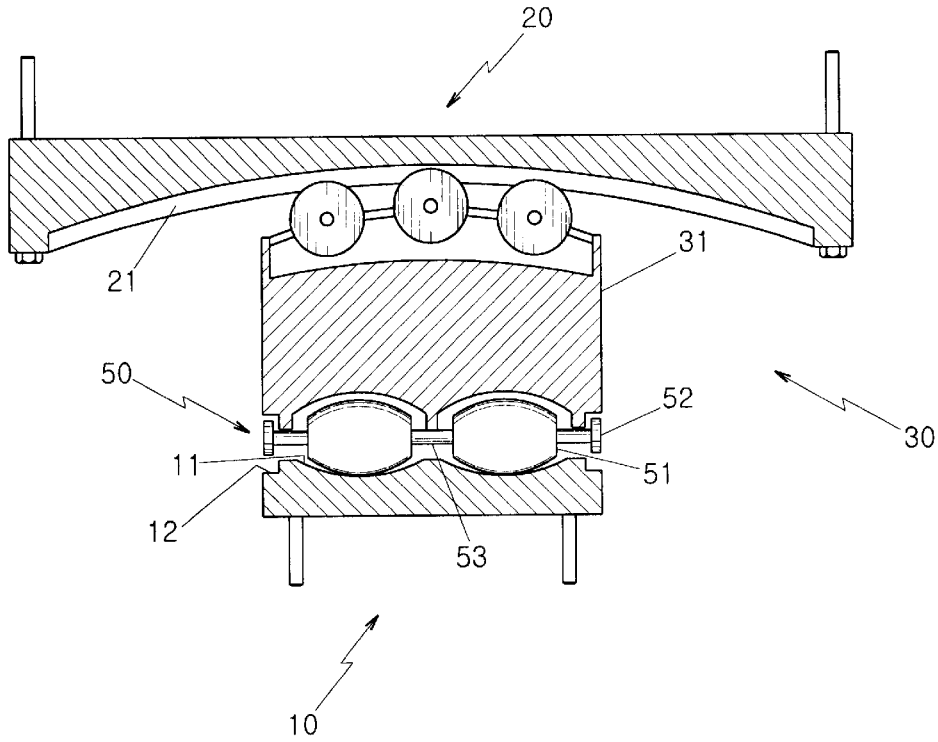

FIG. 10*a* illustrates a sectional view taken along the line 10*b*–10*b* of FIG. 5, and FIG. 10*b* illustrates a sectional view taken along the line 10*b*–10*b* of FIG. 5. In the drawings, the drums 41 of the upper roller 40 of the roller assembly 30 are put on the upper channel 21 of the upper plate 20, and the upper auxiliary drums 42 are put on the upper auxiliary channel 22 of the upper plate 20. In the same way, the drums 51 of the lower roller 50 are put on the lower channel 11 of the lower plate 10, and the lower auxiliary drum 52 are put on the lower auxiliary channel 12 of the lower plate 10. The drums 41 and 51 of the rollers are not in contact with the main body 31. Load transmitted from the friction plates 10 and 20 is transmitted to the roller shafts 43 and 53 though the roller drums 41 and 51, and then, transmitted to the main body 31 from the roller shafts 43 and 53.

Referring to FIGS. 11*a* through 11*d* showing an example that the bi-directional rolling pendulum seismic isolation system 1 of the present invention is installed on a bridge, the operation of the present invention will be described.

The upper plate 20 is fixed on the superstructure 110 of the bridge in such a manner that the upper channel 21 is in a longitudinal direction of bridge, i.e., the second direction becomes the longitudinal direction. The lower plate 10 is fixed on a pier 120 and an abutment 130 of the bridge in such a manner that the lower channel 11 is at right angles to the longitudinal direction of bridge, namely, the first direction is at right angles to the longitudinal direction of bridge (see FIG. 11*a*). An example that the earthquake motion is applied will be described hereinafter.

In the seismic isolation system of the present invention, because the radius of curvature ($R_L$) of the arc of the longitudinal direction of the upper channel 21 is larger than the radius curvature ($r_T$) of the arc section of the lower channel 11, if the horizontal force applied to the upper plate 20 exceeds the rolling friction force between the surface of the upper channel 21 and the contact surface of the upper roller 40, the upper roller 40 starts to roll along the upper channel 21.

Figure 11A:
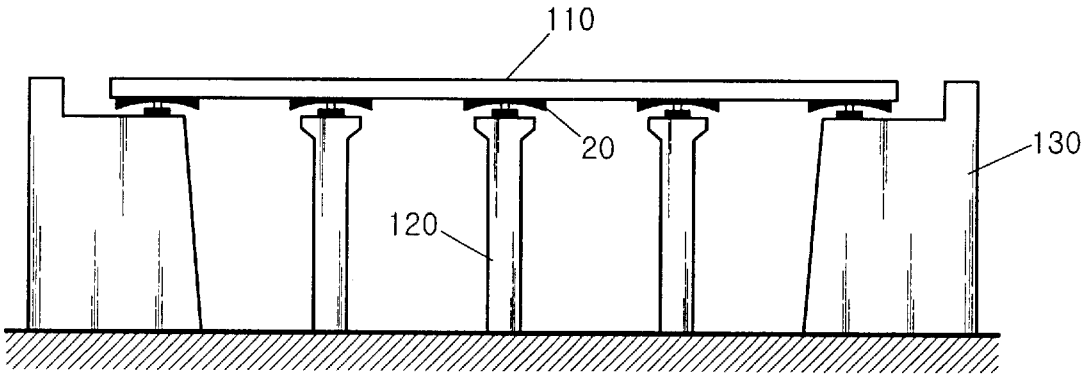
FIGS. 11*a* through 11*d* are explanation views of an operational relationship of the seismic isolation system according to the present invention.
Figure 11B:
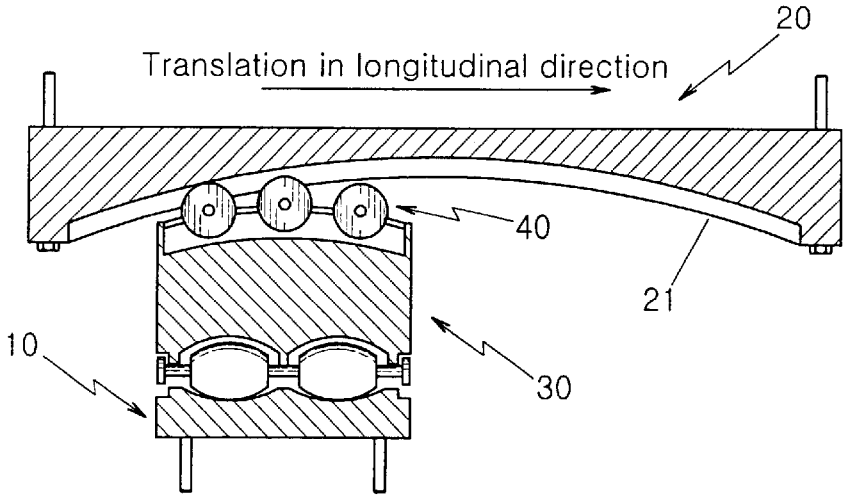
Figure 11C:
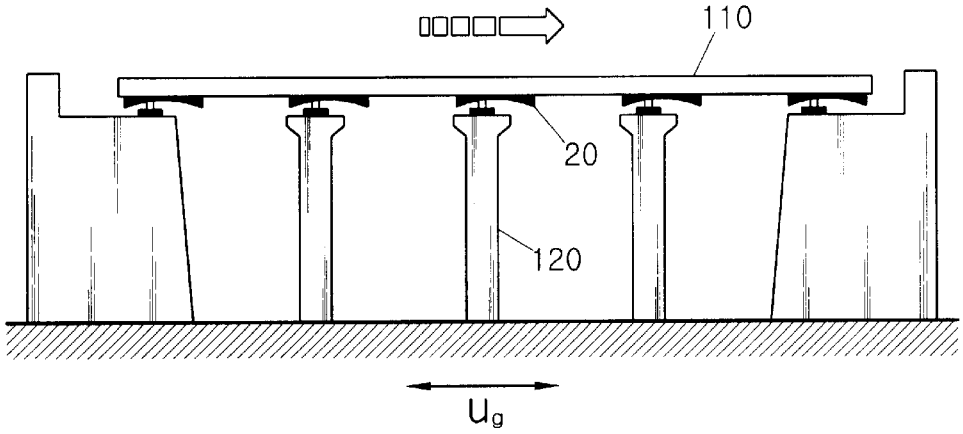

Therefore, if the earthquake motion is applied to the bridge shown in FIG. 11*a* and the seismic force, which exceeds the rolling friction force between the surface of the upper channel 21 and the contact surface of the upper roller 40, is applied to the superstructure 110 of the bridge in the longitudinal direction of bridge, the roller assembly 30 moves along the upper channel 21 (see FIG. 11*b*). Thus, the superstructure 110 of the bridge moves in the longitudinal direction of bridge (see FIG. 11*c*). That is, the upper channel 21 on the roller assembly 30 moves in the longitudinal direction of bridge, and then, the bridge deck moves as shown in FIG. 11*c*. In this process, the roller assembly 30 maintains the stability to the overturning as described above.

Because the superstructure 110 of the bridge moves in a horizontal direction relative to the pier 120 even though the earthquake motion is applied to the superstructure 110 of the bridge, very small amount of earthquake force will be transmitted to the pier 120 in comparison with a case that a fixed bearing is used. Therefore, if the seismic isolation system according to the present invention is installed on the structure, the influence of the earthquake motion directly applied to the structure is very small when the earthquake motion is applied.

Figure 11D:
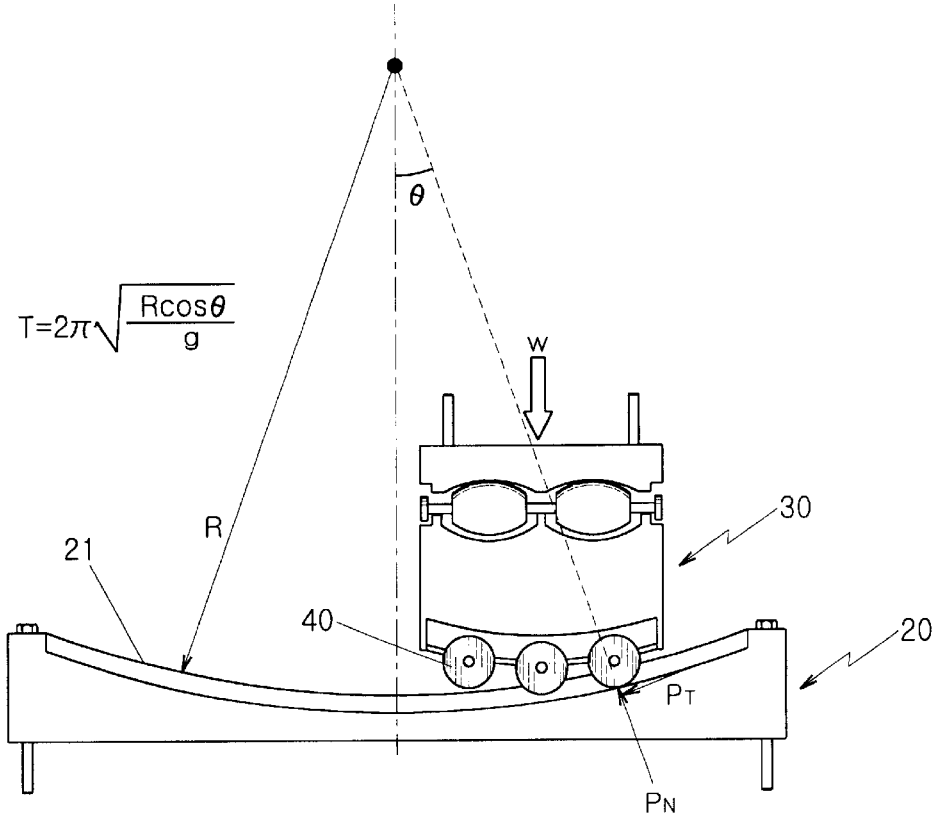

FIG. 11*d* is an upside down view of FIG. 11*b*. The rolling of the roller assembly 30 due to a lateral movement of the upper plate 20 caused by a load, such as earthquake, may be modeled as the pendulum motion of the roller assembly 30 taken along the upper channel 21, as shown in FIG. 11*d*.

If the upper roller 40 moves from the neutral position to a predetermined angle (θ) by rolling along the upper channel 21, the restoring force ($P_T$) for restoring to the neutral position by a pendulum effect is applied (see FIG. 11*d*). The pendulum motion of the roller assembly 30 is stopped by an energy loss due to the friction between the upper roller 40 and the upper channel 21, and thereby also the movement of the structure by the seismic force is stopped.

If the friction coefficient between the upper roller 40 and the upper channel 21 is zero, the upper roller 40 performs a free pendulum motion along the upper channel 21 in FIG. 11*d*. The period (T) of the pendulum motion can be calculated approximately by the following equation (1).

$$T = 2\pi\sqrt{\frac{R\cos\theta}{g}} \tag{1}$$

In the equation (1), if the angle (θ) moved from the neutral position is a value close to zero, the period (T) increases in proportion to the square root of the radius of curvature ($R_L$) of the upper channel 21. In the equation (1), "g" means the acceleration of gravity.

Like the above embodiment, the seismic isolation system of the present invention is not restricted by the installation space because the upper plate 20 is mounted on the superstructure 110 of the bridge and the lower plate 10 is mounted on the pier. Therefore, the radius of curvature ($R_T$ and $R_L$) of the channels 11 and 21 formed on the rolling plate 10 and 20 can be increased.

Figure 1A:
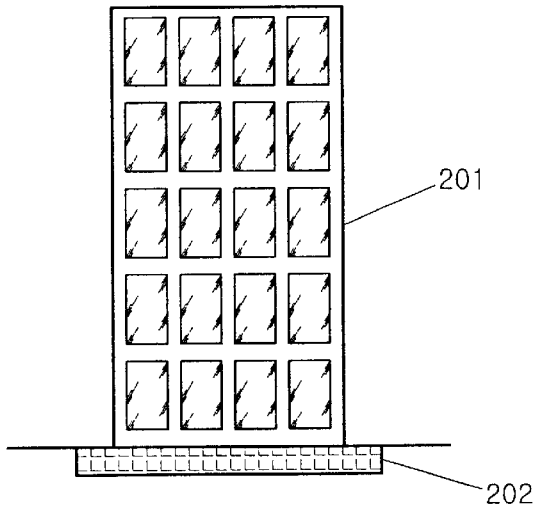
Fig. 1a Prior Art
FIG. 1*a* is a schematic view of a model structure fixed on the ground.
Figure 1B:
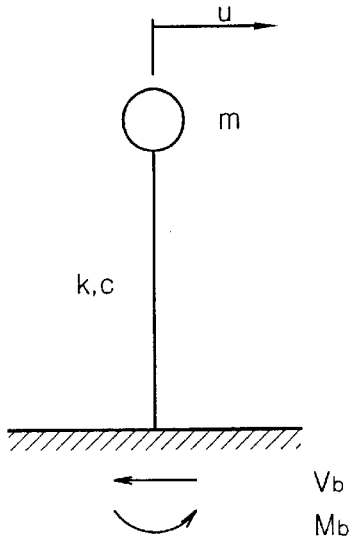
Fig. 1b Prior Art
FIG. 1*b* is a schematic view of a model structure having single degree of freedom fixed on the ground.
Figure 2A:
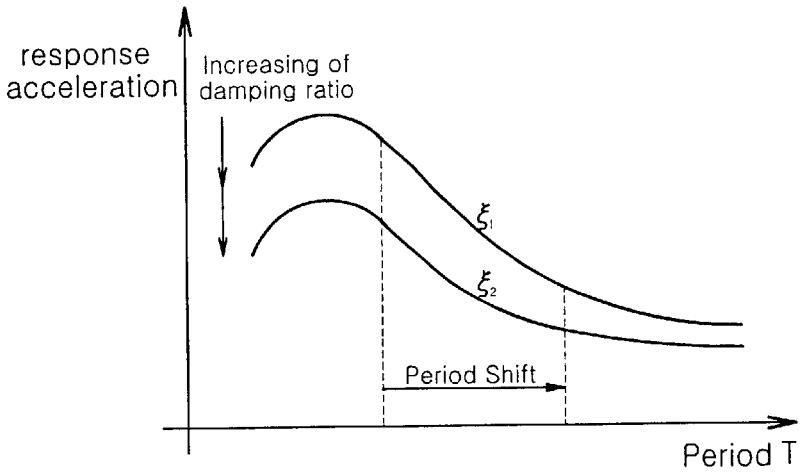
Fig. 2a Prior Art
FIG. 2*a* is a graph of acceleration response spectrum.
Figure 2B:
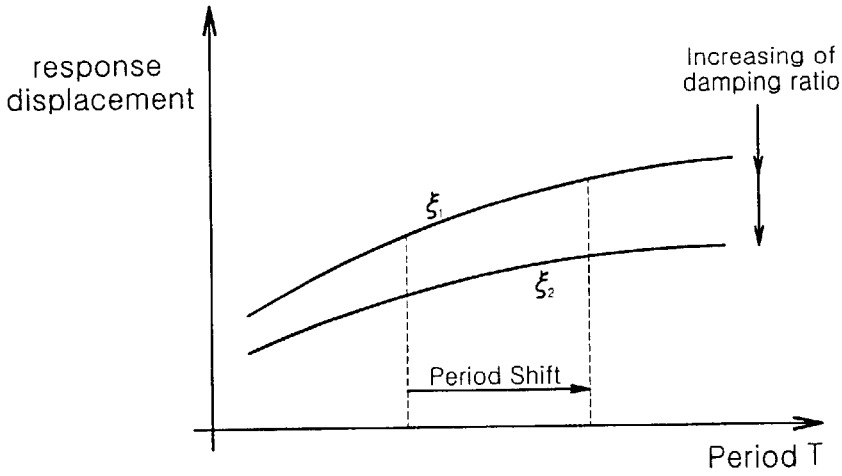
Fig. 2b Prior Art
FIG. 2*b* is a graph of displacement response spectrum.
Figure 3A:
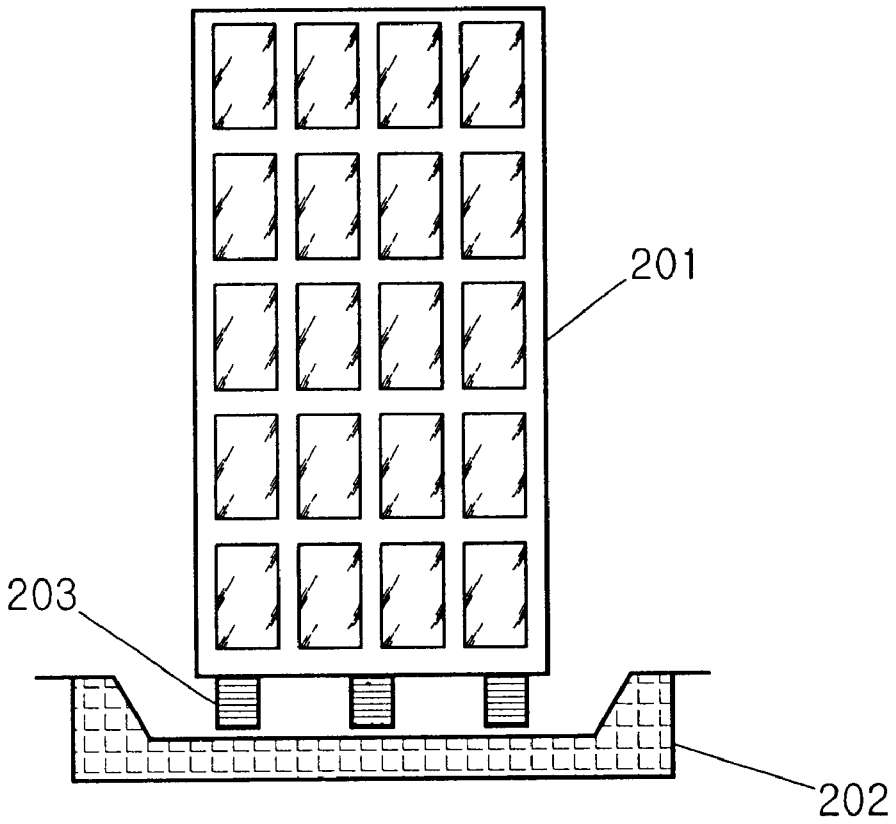
Fig. 3a Prior Art
FIG. 3*a* is a schematic view of a model of seismic isolated structure.
Figure 3B:
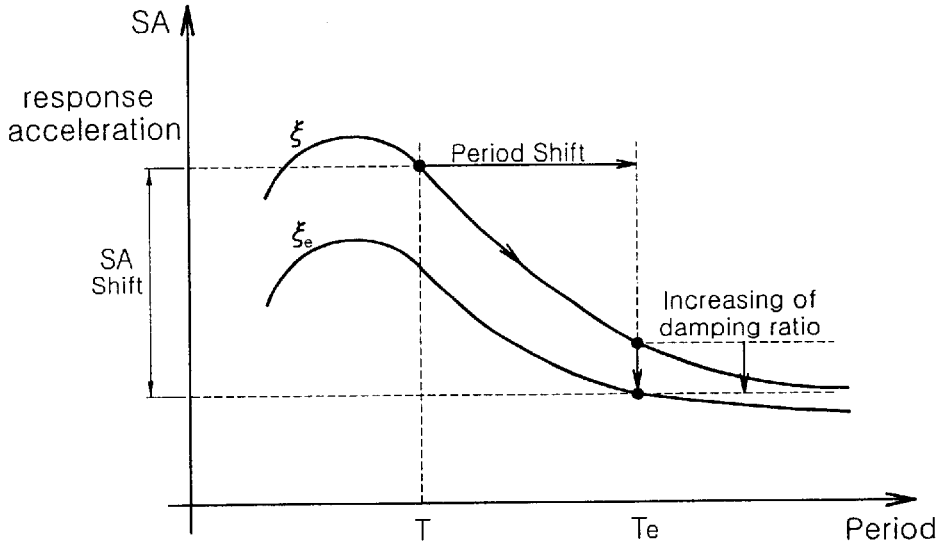
Fig. 3b Prior Art
FIG. 3*b* is a graph showing the change of spectral acceleration by seismic isolation effects.
Figure 3C:
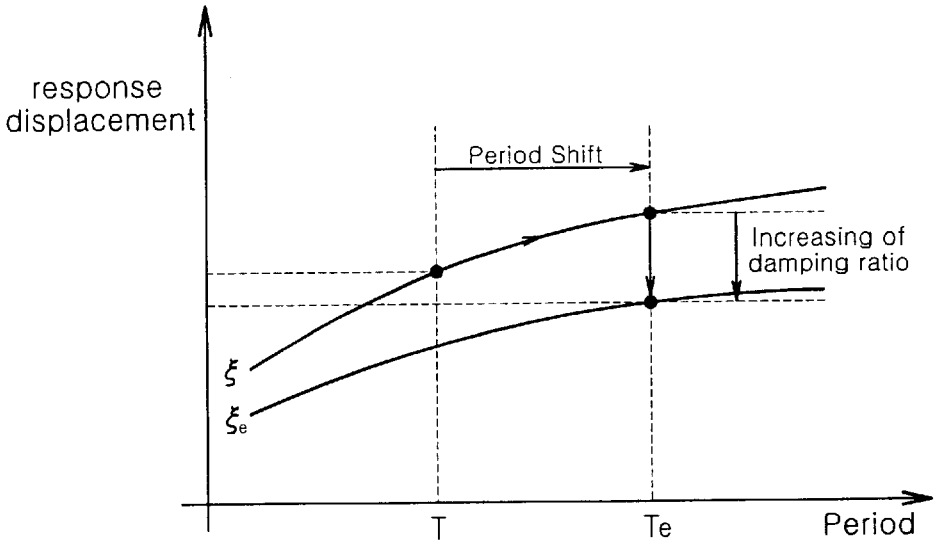
Fig. 3c Prior Art
FIG. 3*c* is a graph showing the change of spectral displacement by the seismic isolation effects.
Figure 4:
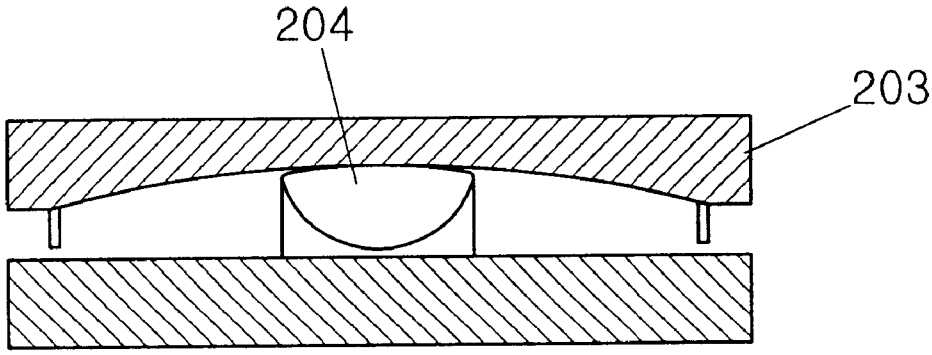
Fig. 4 Prior Art
FIG. 4 is a cross sectional view of a conventional pendulum seismic isolation systems.

It is an advantage that the radius of curvature ($R_T$ and $R_L$) of the channels 11 and 21 can be increased. In detail, in the above embodiment, if the radius of curvature ($R_L$) of the upper channel 21 is increased, the natural period of the whole structural system can be increased, as can be seen from the above equation (1). If the natural period is increased from T to $T_e$, the seismic force is reduced (see FIG. 3*b*). At the same time, because high energy dissipation effects (damping effects) may be obtained by adjusting the friction coefficient properly, also the displacement may be restricted. The seismic isolation system according to the present invention can reduce the seismic force, significantly compared with the conventional seismic isolation systems.

The seismic force due to the earthquake may be applied in a direction perpendicular to a longitudinal axis of bridge. If the seismic force in the direction perpendicular to the longitudinal axis of bridge is applied to the superstructure 110 of the bridge, the lower roller 50 of the roller assembly 30 performs the free pendulum motion along the lower channel 11 similar to the above, thereby reducing the seismic force in the direction perpendicular to the longitudinal axis of bridge. The seismic isolation system of the present invention has independent seismic force reducing effects to the two directions simultaneously.

In the above embodiment, the seismic isolation system is installed to have seismic force reducing effects in the longitudinal direction of bridge and the direction perpendicular to the longitudinal axis, but the installation directions of the lower plate 10 and the upper plate 20 may be selected freely.

Especially, the seismic force applied in an arbitrary direction may be decomposed into the longitudinal direction of the bridge and the direction perpendicular to the longitudinal axis. Seismic force in each direction can be reduced by the above principle. In the bi-directional rolling pendulum seismic isolation system of the present invention, even though the lower channel 11 is installed in the first direction and the upper channel 21 is installed in the second direction, the upper plate 20 and the lower plate 10 can perform the relative motion in any directions to each other by the combination of the first direction and the second direction. Thus, effective seismic isolation actions in all horizontal directions can be achieved.

Hereinafter, a modification of the seismic isolation system of the present invention will be described by referring to FIGS. 12*a* through 20*b*.

Figure 12A:
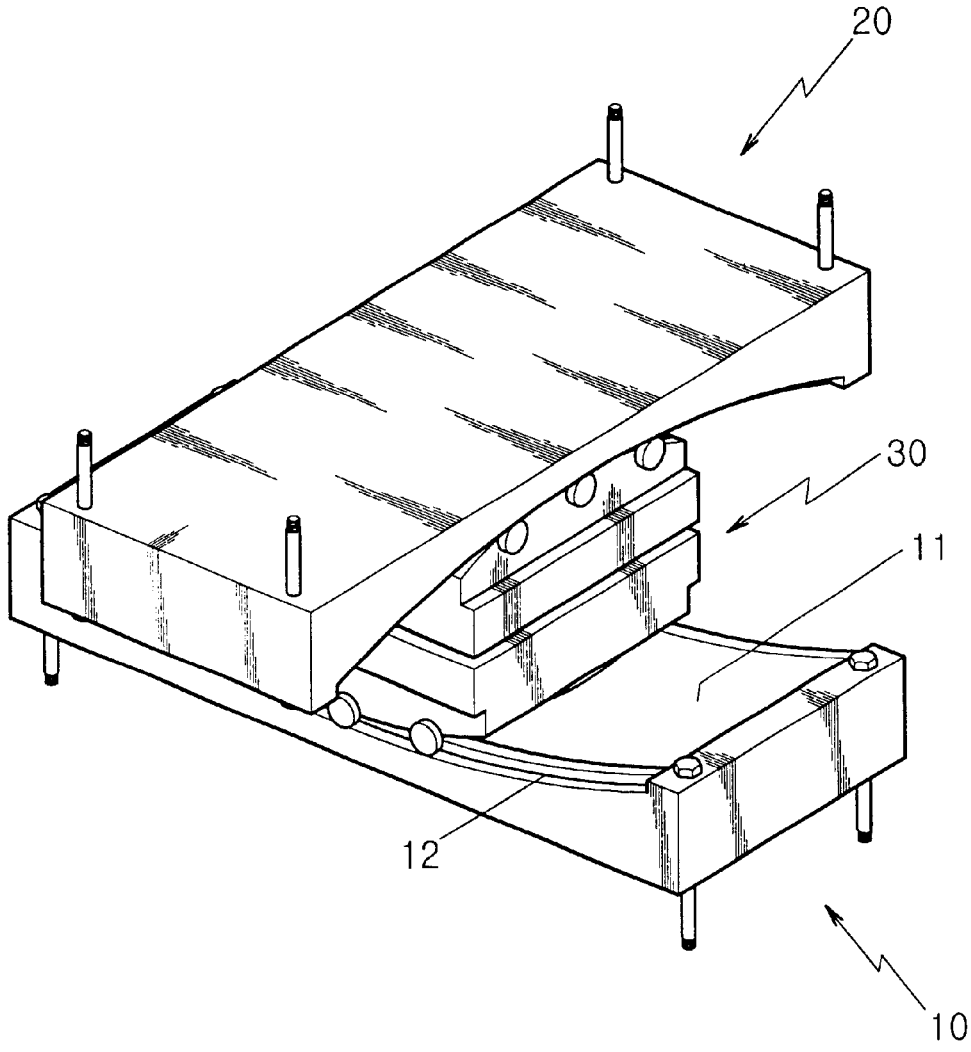
FIGS. 12*a* through 12*d* are a sectional view and perspective views of a roller and a bi-directional rolling pendulum seismic isolation system having one-channel plate.
Figure 12B:
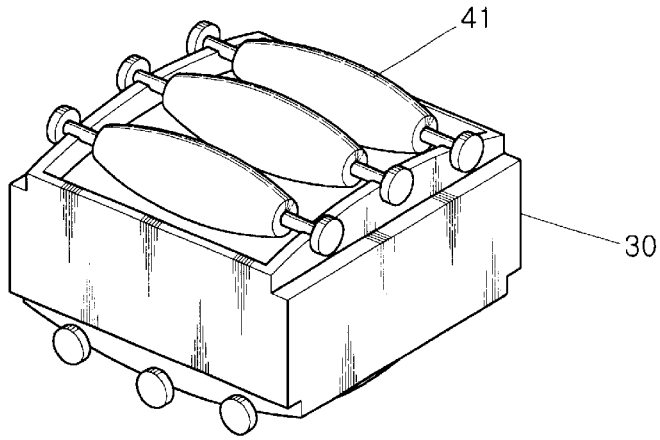
Figure 12C:
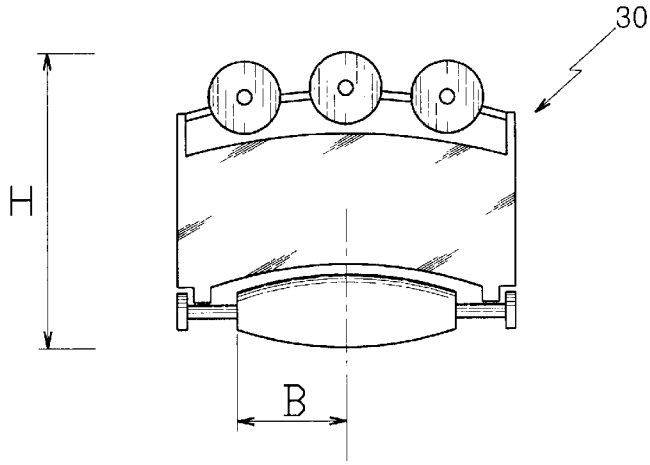
Figure 12D:
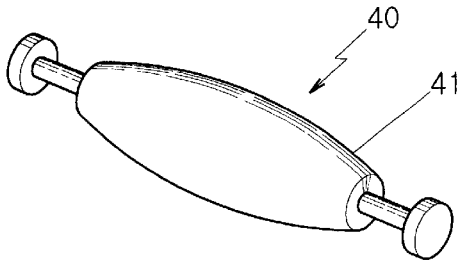

The seismic isolating system according to the present invention may be a one-channel type rolling pendulum seismic isolation system having the friction plate on which one channel is formed. FIGS. 12*a* through 12*c* illustrate one-channel type directional rolling pendulum seismic isolation systems including upper and lower plates on which one channel is formed, and a roller assembly on which rollers having one drum are provided. FIG. 12*a* illustrates a perspective view of the seismic isolation systems, FIG. 12*b* illustrates a perspective view of the one-channel type un-separable roller assembly 30 constituting the seismic isolation system, and FIG. 12*c* illustrates a sectional view of the roller assembly 30. FIG. 12*d* illustrates the roller 40 having one drum 41. The above seismic isolation systems have the same structure as the two-channel type rolling pendulum seismic isolation system in all aspects beside the number of the channels and the drums, and therefore, their description will be omitted.

The roller assembly 30 of the present seismic isolation system can be a type separable into upper and lower parts. The upper and lower parts may be manufactured separately and combined. The separable roller assembly 30 includes an upper main body 61 having an upper surface on which the upper rollers 40 are mounted, a lower main body 60 having a lower surface on which the lower rollers 50 are mounted, and elastic or elasto-plastic objects inserted between the lower and upper main bodies 60 and 61.

If the elastic or elasto-plastic objects are adjusted in the shape and elasticity properly, the lower and upper main bodies 60 and 61 can be inclined to a horizontal surface or a vertical surface according to the movement of the roller assembly 30 when the roller assembly 30 is moved in the channels 11 and 21. As the result, because the plurality of rollers 40 and 50 can be in contact with the channels 11 and 21 at the same time, vertical load may be shared by the rollers 40 and 50 and also the motion of the rollers can be smooth. Furthermore, the elastic or elasto-plastic objects may cause a seismic isolation effect in a vertical direction. By connecting the vertical seismic isolation effect with a horizontal seismic isolation effect caused by the rollers 40 and 50, a three-dimensional seismic isolation system capable of performing a three-dimensional seismic isolation function may be achieved.

Figure 13A:
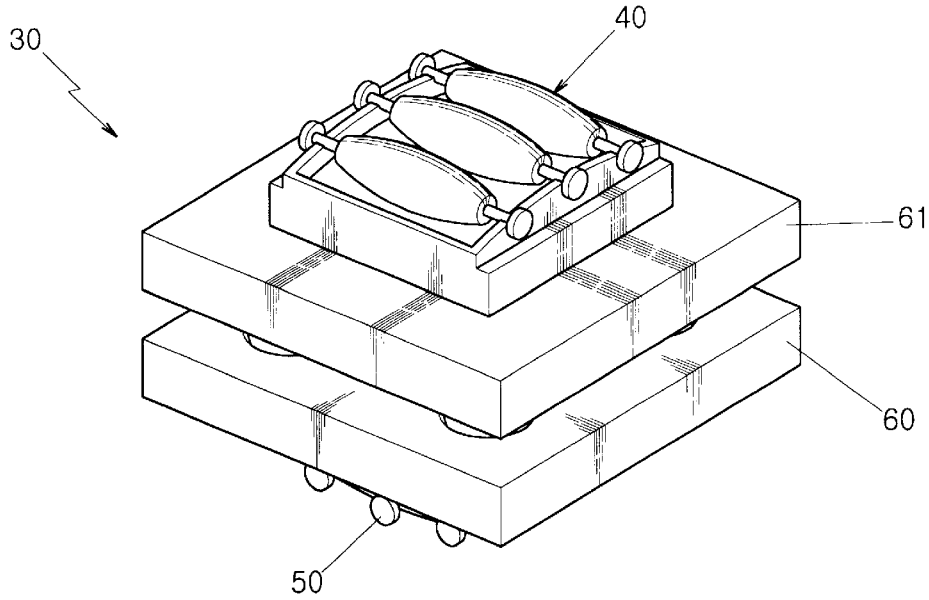
FIGS. 13*a* through 13*c* are a perspective view and exploded perspective views of a preferred embodiment of a separable roller assembly.
Figure 13B:
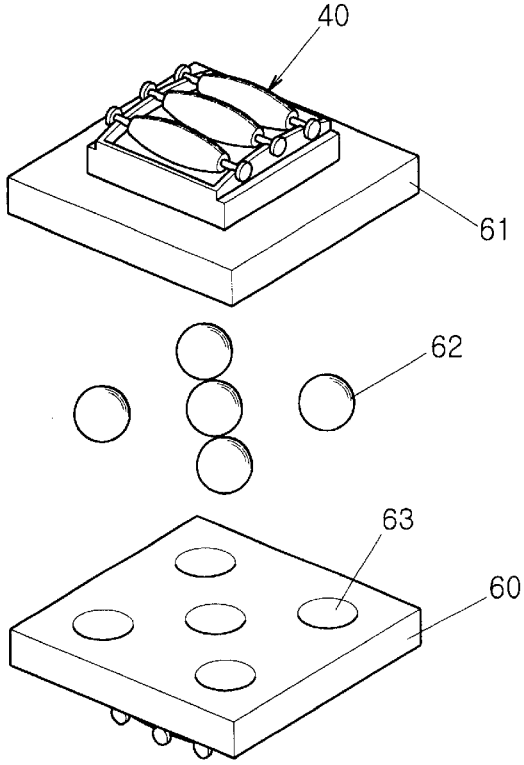
Figure 13C:
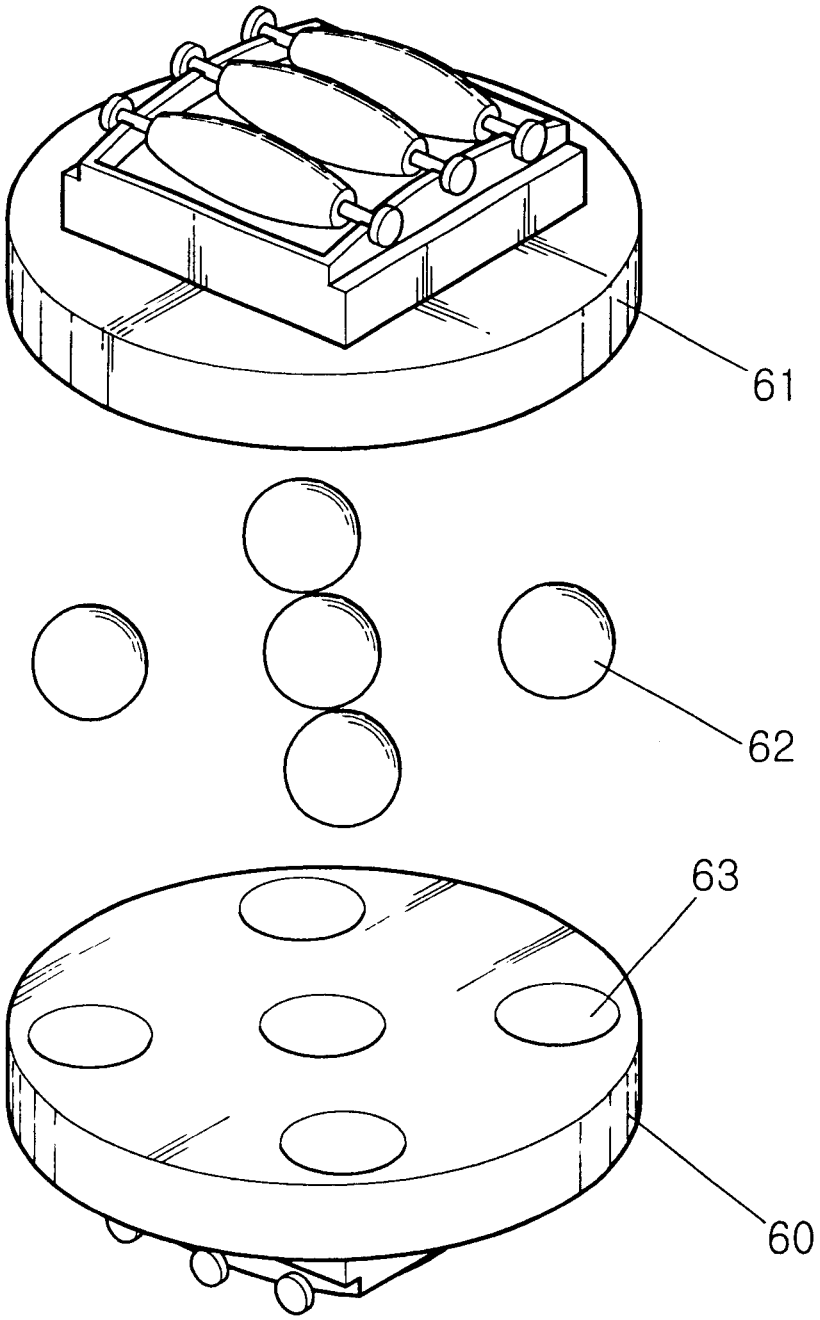

FIGS. 13*a* through 13*c* show examples of the separable roller assembly 30. In this embodiment, the elastic or elasto-plastic objects are spheres 62 having a predetermined elasticity and damping capacity. The lower and upper main bodies 60 and 61 have holes 63 formed in the form of a hemisphere respectively to house the spherical elastic or elasto-plastic objects 62. The lower and upper main bodies 60 and 61 are not restricted to the disc shape, and may be made in various shapes, such as a polygon including a rectangle, an oval, or the likes (see FIG. 13*c*).

If the separable roller assembly 30 having the elastic or elasto-plastic objects 62 is used, because the elasticity and the damping capacity are given to the spheres, vertical seismic isolation effects can be induced and unexpected stress, which may be generated due to error in construction, can be absorbed.

Figure 13D:
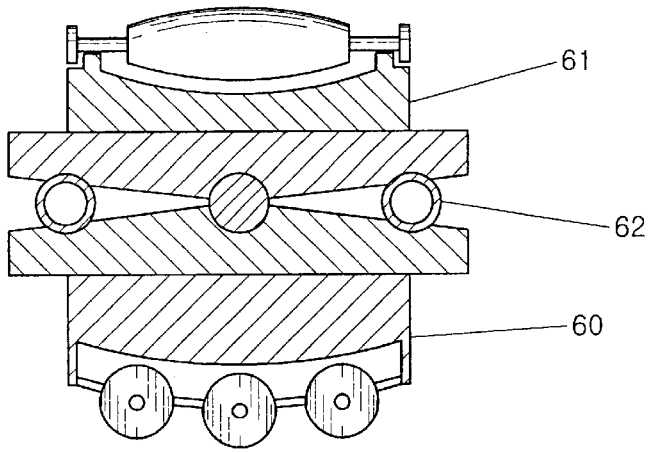
FIG. 13*d* is a sectional view of the preferred embodiment of the separable roller assembly.

As shown in FIG. 13*d*, the stiffness of a central sphere 62 may be large and that of spheres 62 located at the circumference of the main bodies may be small. At this time, the main bodies in which a shape of a friction surface of the central sphere 62 and a shape of the surface of the lower and upper main bodies 60 and 61 are processed may be used to vertically rotate on a horizontal axis that the upper and lower main bodies pass the central sphere 62. In case of the un-separable main bodies, only some of the plurality of rollers may contact with the friction plates 10 and 20 when the roller assembly 30 moves as shown in FIG. 11*b* or 11*d*, and thereby the load is concentrated on some of the rollers. However, if the roller assembly is constructed in a structure shown in FIG. 13*d*, the lower and upper main bodies 60 and 61 can be rotated relatively as shown in FIG. 13*e*, the plurality of rollers 40 and 50 can contact with the channels 11 and 21, and thereby, the vertical load may be shared by the rollers 40 and 50 and the motion of the rollers 40 and 50 may be smooth.

Figure 14A:
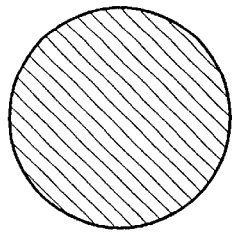
FIGS. 14*a* through 14*d* are sectional views of various embodiments of disc shape elastic or elasto-plastic objects of the separable roller assembly.
Figure 14B:
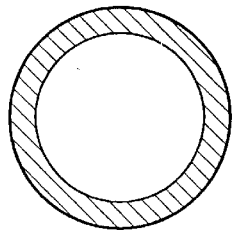
Figure 14C:
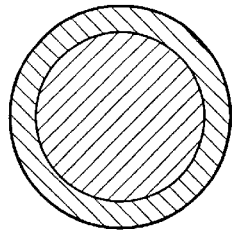
Figure 14D:
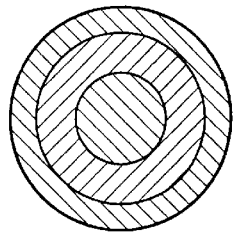

The spheres used as the elastic or elasto-plastic objects 62 may be solid spheres filled with appropriate materials (see FIG. 14*a*), hollow spheres (see FIG. 14*b*), dual shell type spheres filled with two kinds of contents (see FIG. 14*c*), or triple shell type spheres filled with three kinds of materials (see FIG. 14*d*). In the case of the shell type spheres, if the outermost shell is made of an elastic material and the inner shell is made of viscoelastic material, a three-dimensional seismic isolation system, which shows the vertical seismic isolation effects and damping effect, can be constructed.

Figure 15A:
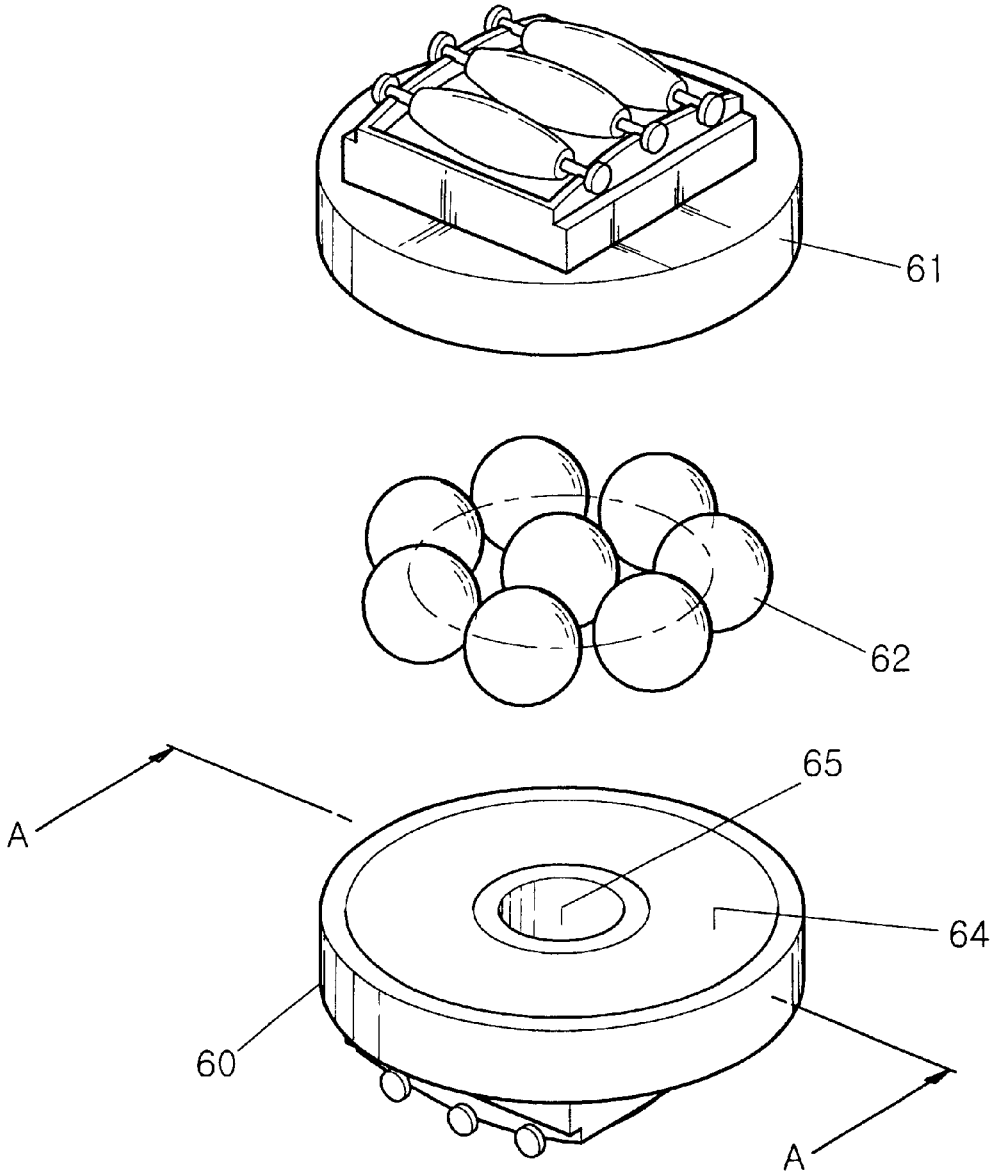
FIGS. 15*a* through 15*c* are schematic views of another embodiment of the separable roller assembly.
Figure 15B:
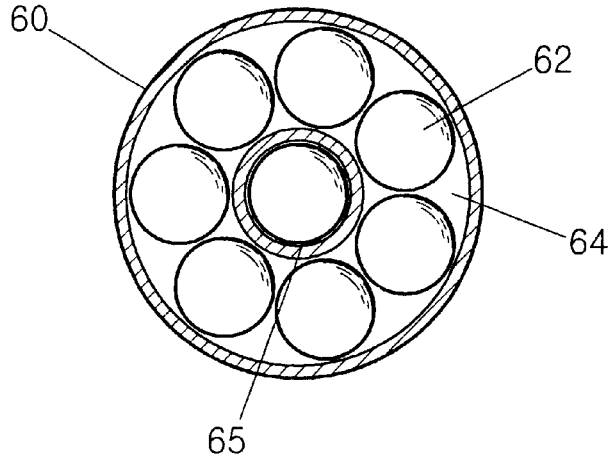
Figure 15C:
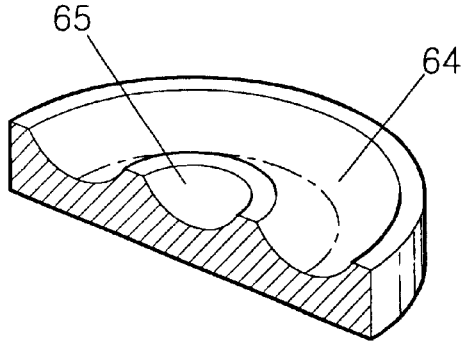

FIGS. 15*a* through 15*c* show another example of the separable roller assembly 30. To show a contour hole 64 described later, FIG. 15*c* shows a partial cut lower main body 60. In this embodiment, the lower and upper main bodies 60 and 61 have a circular contour hole 64 formed in the inner surface and a spherical hole 65 formed at the center, and the elastic or elasto-plastic objects are inserted in the contour hole 64 and the circular spherical hole 65. In the bi-directional seismic isolation system of the present invention, because the bi-directional motion is performed independently, unexpected torsional stress may be applied to the roller assembly 30. However, in the roller assembly 30 shown in FIGS. 15*a* through 15*c*, because the lower main body 60 and the upper main body 61 can rotate freely with respect to the vertical axis, development of the torsion stress can be reduced.

Figure 13E:
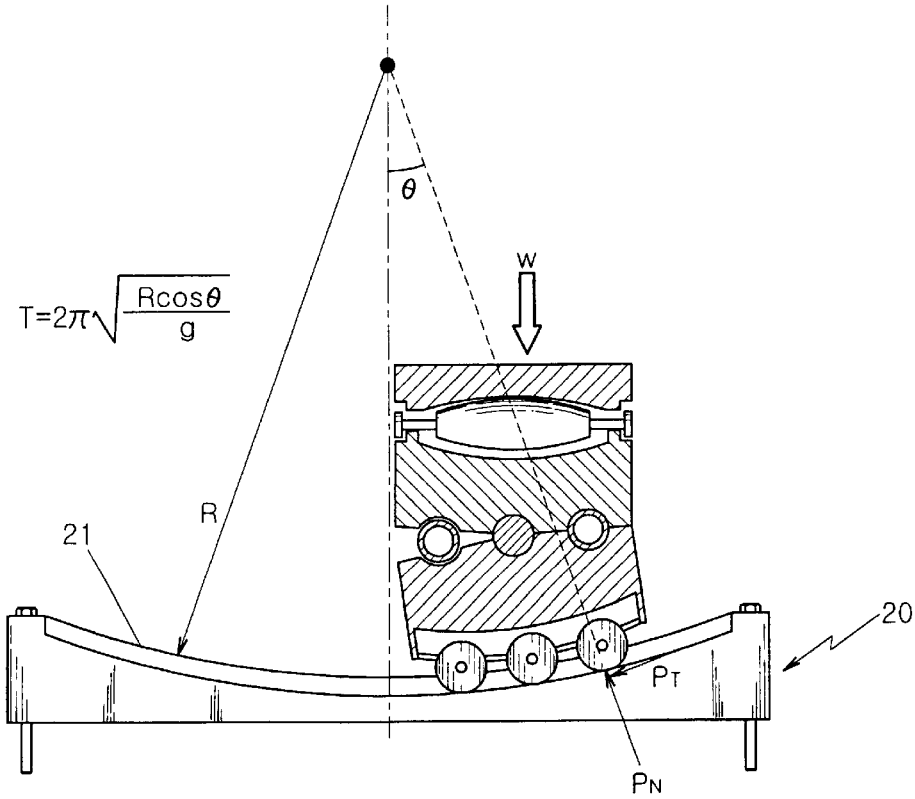
FIG. 13*e* is a conceptual view of an operation of the preferred embodiment of the separable roller assembly.

As described the above in connection with FIGS. 13*d* and 13*e*, if the stiffness and size of the spheres 62, the shape of the friction surface of the central sphere 62 and the shape of the surface of the lower and upper main bodies 60 and 61 are determined properly, the lower and upper main bodies 60 and 61 can rotate relative to each other as shown in FIG. 13*e* and the plurality of rollers can simultaneously contact with the channels, so that the vertical load can be shared by the rollers and the motion of the rollers becomes smooth. Furthermore, the elastic or elasto-plastic objects can cause the vertical seismic isolation effect, and by connecting the vertical seismic isolation effect with a horizontal seismic isolation effect caused by the rollers 40 and 50, a three-dimensional seismic isolation system capable of performing a three-dimensional seismic isolation function may be constructed.

Figure 16A:
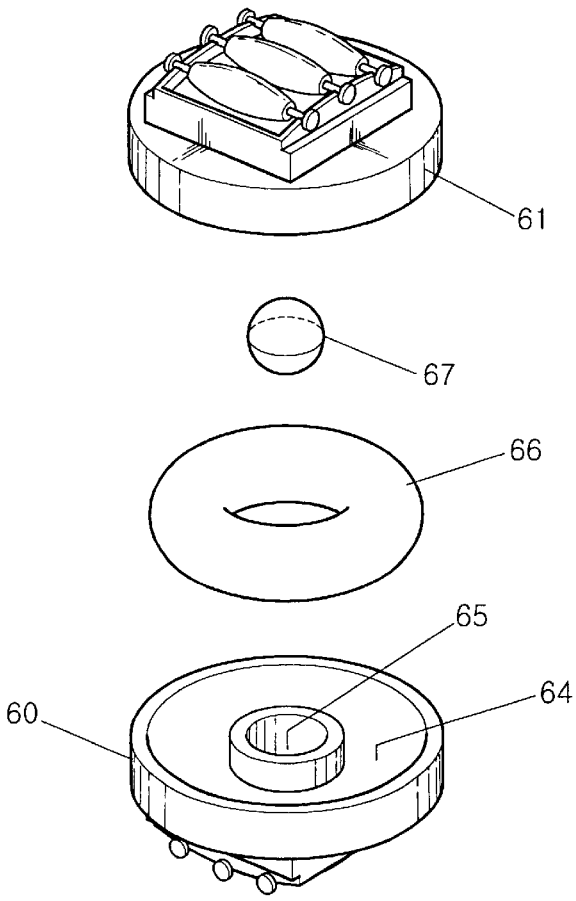
FIGS. 16*a* and 16*b* are schematic views of a further embodiment of the separable roller assembly.
Figure 16B:
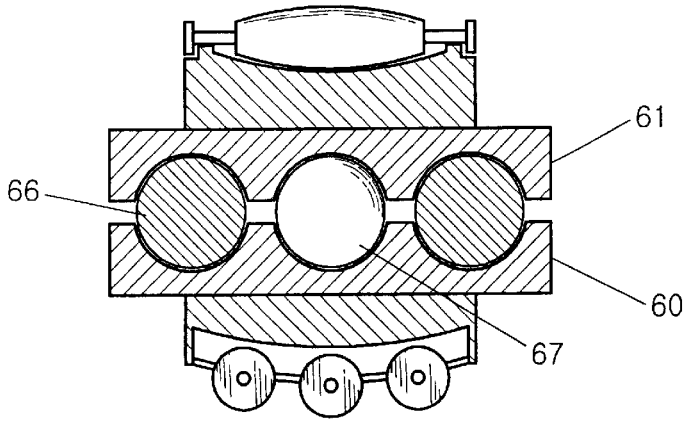
Figure 17A:
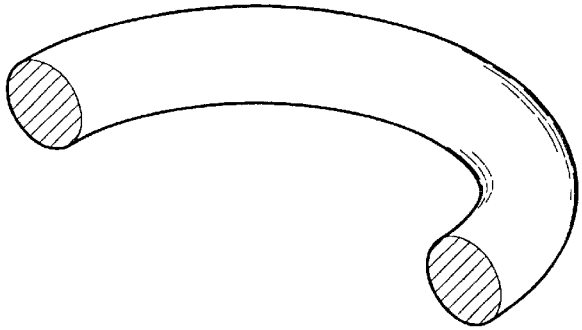
FIGS. 17*a* through 17*c* are sectional views of various embodiments of annular elastic or elasto-plastic objects of the separable roller assembly.
Figure 17B:
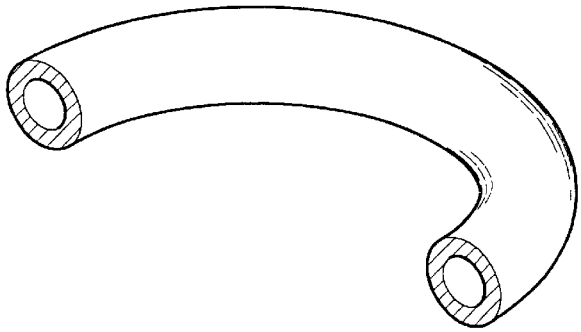
Figure 17C:
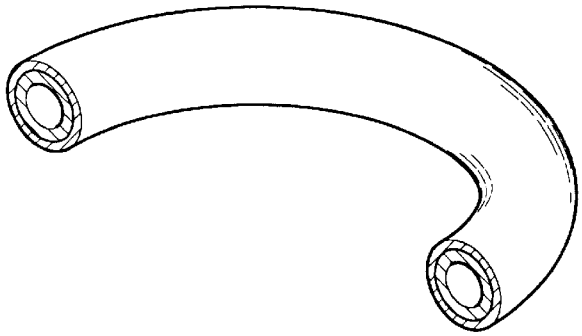

In the above modification, an annulus 66 is mounted in the contour hole 64 and a sphere 67 is mounted in the spherical hole 65 of the center thereof (see FIGS. 16*a* and 16*b*). In this case, the annulus 66 is a solid annulus filled with contents (see FIG. 17*a*), a hollow annulus (see FIG. 17*b*) or a multiple shell type annulus (see FIG. 17*c*).

As described the above in connection with FIGS. 13*d* and 13*e*, the stiffness and size of the spheres 67 and the annulus 66, the shape of the friction surface of the central sphere 67 and the shape of the surface of the lower and upper main bodies 60 and 61 are determined properly, the lower and upper main bodies 60 and 61 can rotate relative to each other as shown in FIG. 13*e* and the plurality of rollers can simultaneously contact with the channels, so that the vertical load can be shared by the rollers and the motion of the rollers becomes smooth. Furthermore, the elastic or elasto-plastic objects can cause the vertical seismic isolation effect, and by connecting the vertical seismic isolation effect with a horizontal seismic isolation effect caused by the rollers 40 and 50, a three-dimensional seismic isolation system capable of performing a three-dimensional seismic isolation function may be made.

Figure 18A:
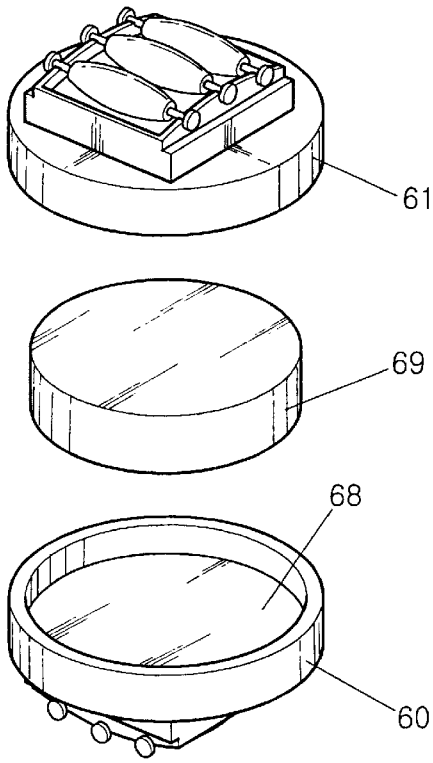
FIGS. 18*a* and 18*b* are schematic views of another embodiment of the separable roller assembly.
Figure 18B:
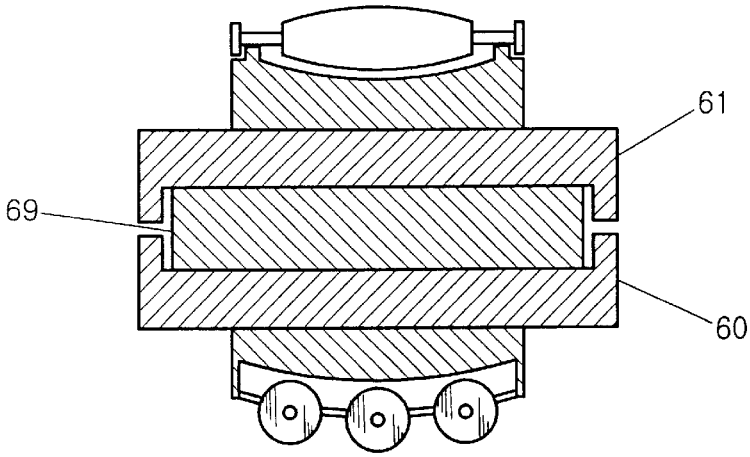
Figure 19A:
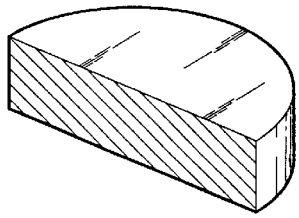
FIGS. 19*a* through 19*d* are sectional views of various embodiments of disc elastic or elasto-plastic objects of the separable roller assembly.
Figure 19B:
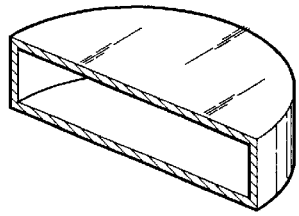
Figure 19C:
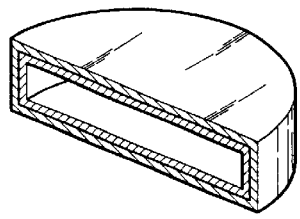
Figure 19D:
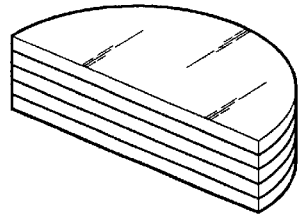

In another modification, as shown in FIGS. 18*a* and 18*b*, it is possible that the lower and upper main bodies 60 and 61 have a space 68, and the elastic damper including a disc 69 is mounted in the space 68. The disc 69 is a solid disc filled with contents (see FIG. 19*a*), a hollow disc (see FIG. 19*b*), a multiple shell type disc (see FIG. 19*c*), or a multi-floor disc made of elastic material of a plurality of floors (see FIG. 19*d*).

Figure 20A:
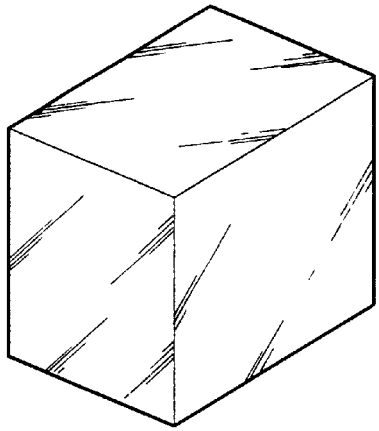
FIGS. 20*a* and 20*b* are perspective views of elastic or elasto-plastic objects inserted into the center of the separable roller assembly.
Figure 20B:
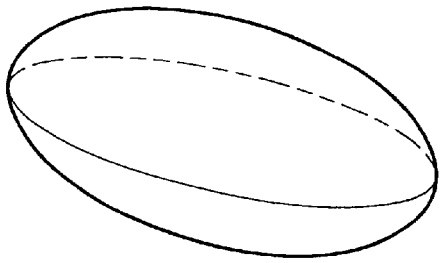

In the present invention, elastic or elasto-plastic objects have a hexahedron shape (see FIG. 20*a*) or an ellipsoid shape (see FIG. 20*b*). As described the above in connection with FIGS. 13*d* and 13*e*, if the shape, stiffness and size of the elasto-plastic objects are determined properly, the lower and upper main bodies 60 and 61 can rotate relative to each other as shown in FIG. 13*e* and the plurality of rollers can simultaneously contact with the channels, so that the vertical load can be shared by the rollers and the motion of the rollers becomes smooth. Furthermore, the elastic or elasto-plastic objects can cause the vertical seismic isolation effect, and by connecting the vertical seismic isolation effect with a horizontal seismic isolation effect caused by the rollers 40 and 50, a three-dimensional seismic isolation system capable of performing a three-dimensional seismic isolation function may be made.

Figure 21A:
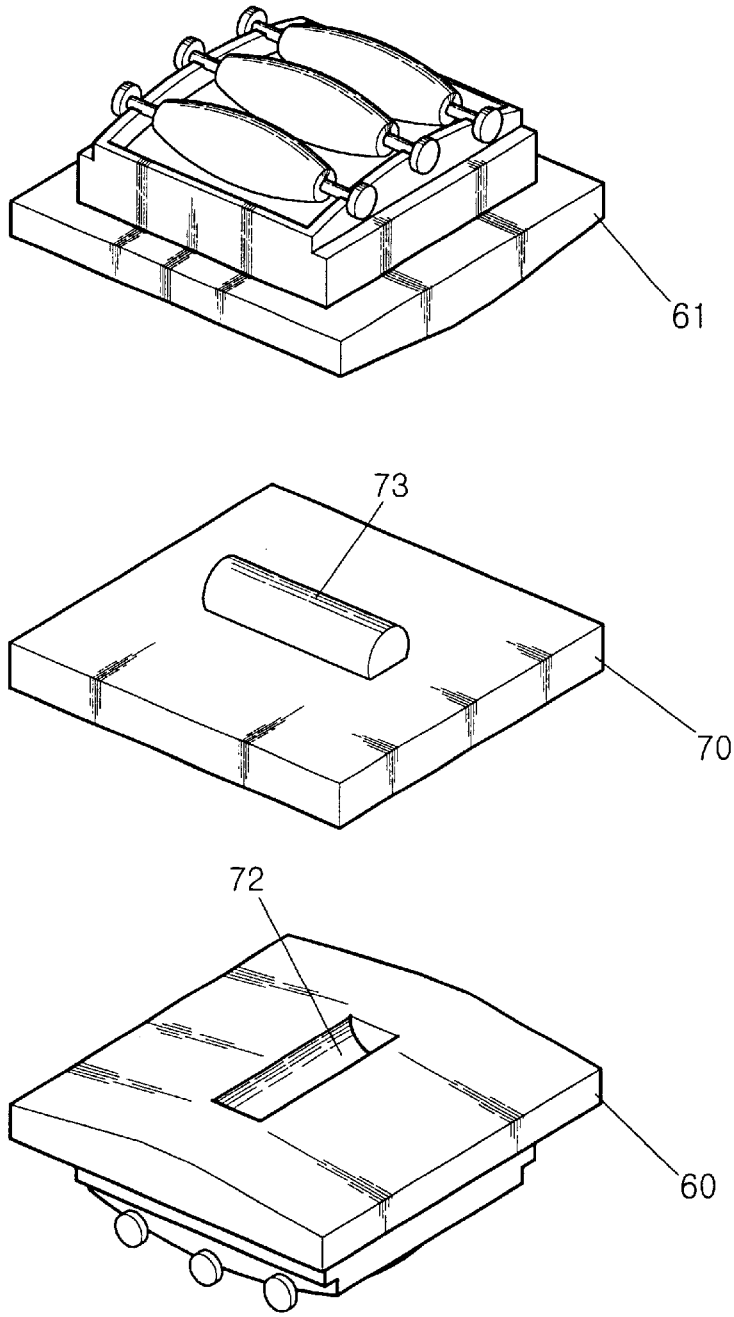
FIG. 21*a* is a perspective view of an articulated roller assembly.
Figure 21B:
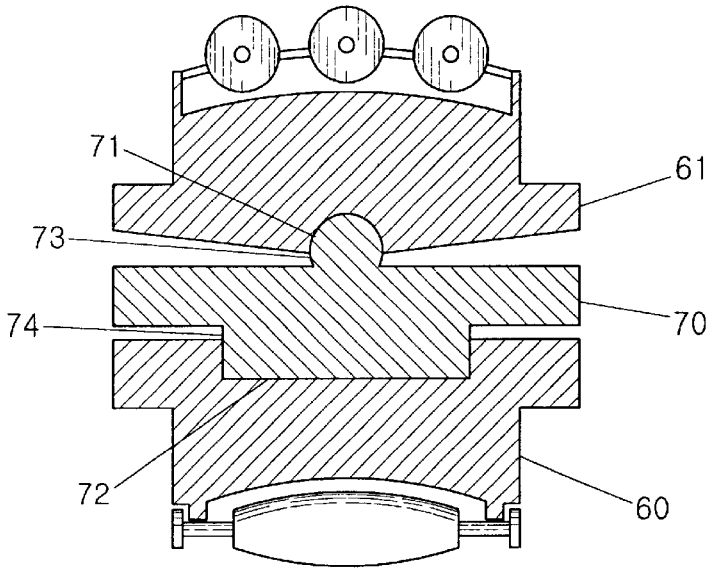
FIG. 21*b* is a sectional view of the articulated roller assembly.
Figure 21C:
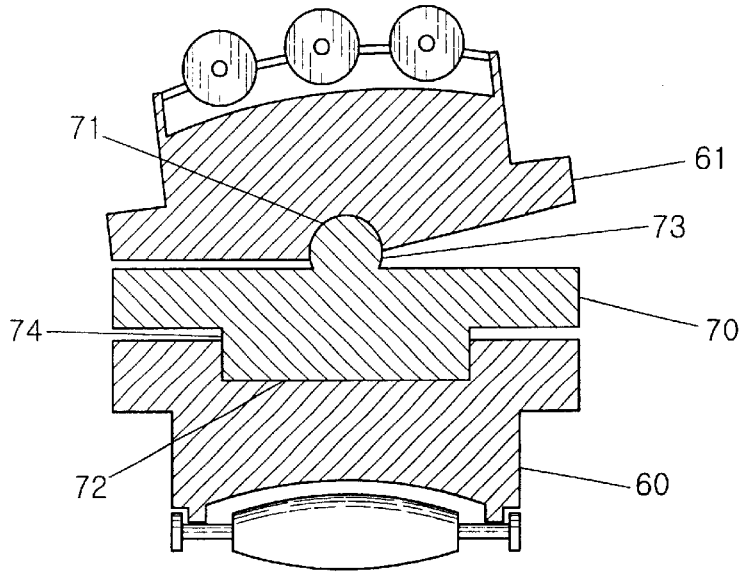
FIG. 21*c* is a conceptual view of an operation of the articulated roller assembly.

FIGS. 21*a* through 21*c* illustrate a preferred embodiment of an articulated roller assembly. In this embodiment, a central articulated main body 70 is disposed between the lower and upper main bodies 60 and 61, and thereby the lower and upper main bodies 60 and 61 perform a restricted rotation around a horizontal axis. That is, the lower and upper main bodies 60 and 61 can perform an articulated motion. As shown in FIG. 21*a*, the upper main body 61 has a half-cylindrical hole 71 formed on the lower surface thereof parallel to the direction of the upper roller shafts, the lower main body 60 has a half-cylindrical hole 72 formed on the upper surface thereof parallel to the direction of the lower roller shafts, and the intermediate main body 70 has a half-cylindrical projection 73 formed on an upper surface thereof parallel to the direction of the upper roller shafts and a half-cylindrical projection 74 formed on a lower surface thereof parallel to the direction of the lower roller shafts. As shown in FIG. 21*b*, if the friction coefficient of the friction surface is maintained in a low condition when the upper, lower and intermediate main bodies are connected to each other, the lower and upper main bodies 60 and 61 can perform the rotational motion on the horizontal axis relative to the intermediate main body 70, i.e., the articulated motion, as shown in FIG. 21*c*. Then, because the plurality of rollers can contact with the channels as described above referring to FIGS. 13*d* and 13*e*, the vertical load will be shared by the rollers and the motion of the rollers can be smooth.

Figure 21D:
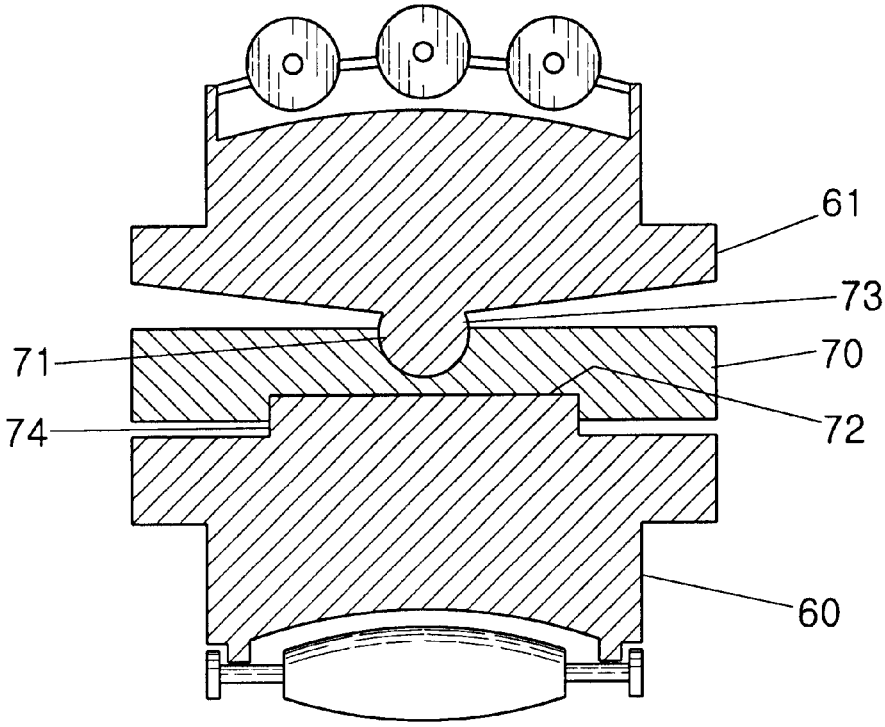
FIG. 21*d* is a sectional view of another embodiment of the articulated roller assembly.

FIG. 21*d* illustrates another embodiment of the articulated roller assembly.

In another embodiment of the articulated roller assembly, as shown in FIG. 21*d* the upper main body 61 has a half-cylindrical projection 73 formed on the lower surface thereof parallel to the direction of the upper roller shafts, the lower main body 60 has a half-cylindrical projection 74 formed on the upper surface thereof parallel to the direction of the lower roller shaft, and the intermediate main body 70 has a half-cylindrical hole 71 formed on the upper surface thereof parallel to the direction of the upper roller shafts and a half-cylindrical hole 72 formed on the lower surface thereof parallel to the direction of the lower roller shafts, However, the articulated roller assembly of the second embodiment has the same performance as that of the first embodiment.

Also, FIGS. 21*a*–21*c* illustrates an embodiment of the roller having one drum to be coupled with the one-channel friction plates. However, the roller may have two drums to be coupled with the two-channel friction plates as shown in FIG. 9*a*.

The rolling pendulum seismic isolation systems according to the present invention can be used not only in the bi-direction but also in a uni-direction.

Figure 22A:
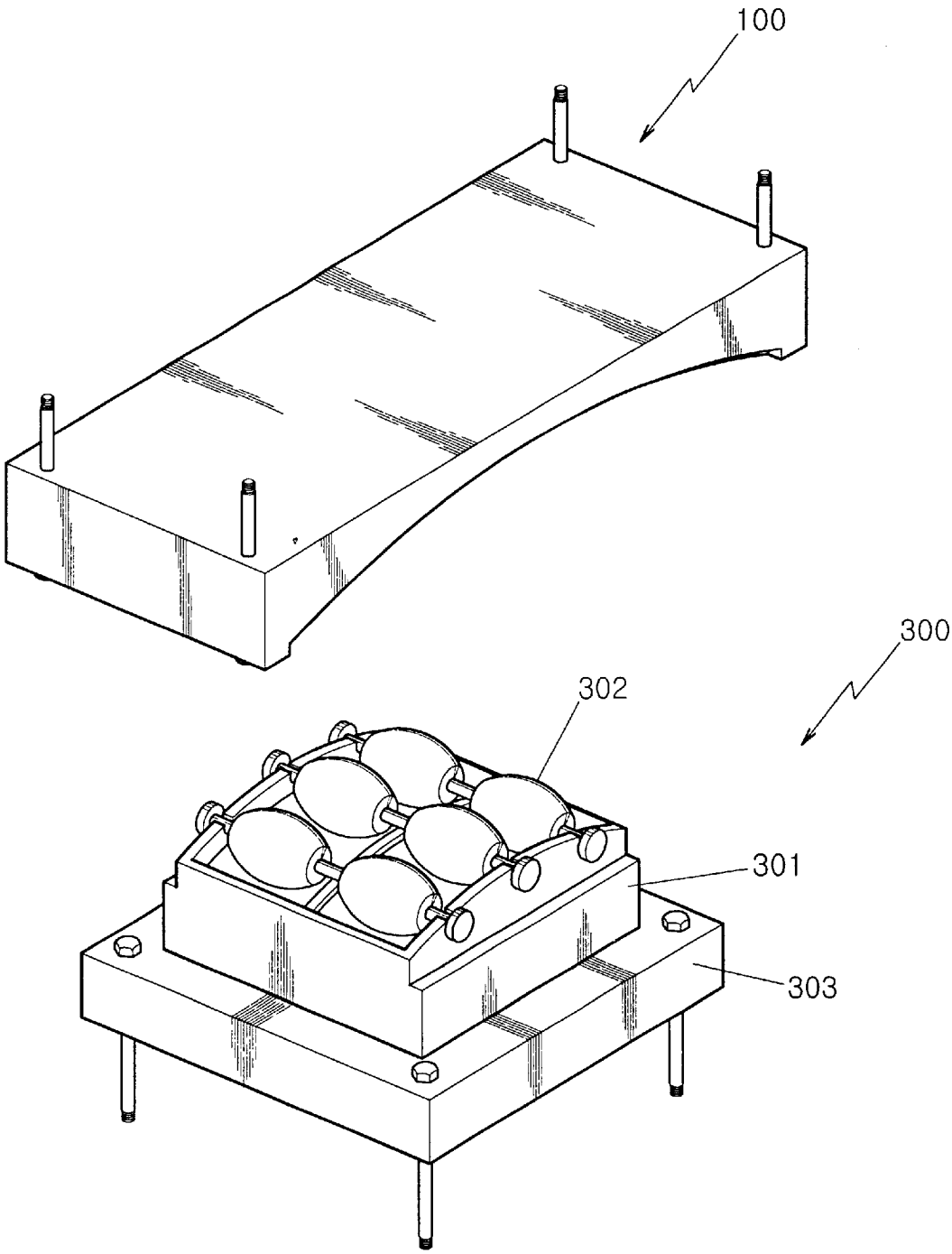
FIGS. 22*a* through 22*c* are perspective views and a sectional view of a uni-directional rolling pendulum seismic isolation system having two-channel plate.
Figure 22B:
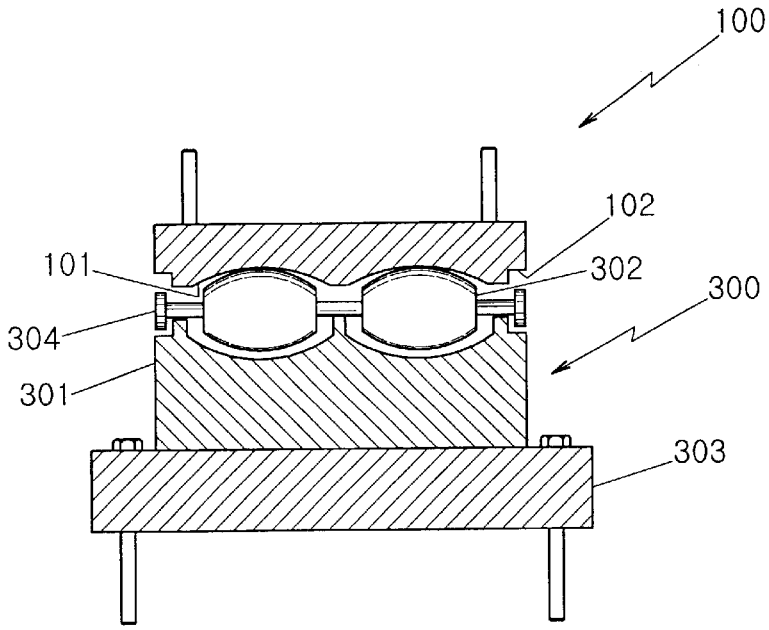
Figure 22C:
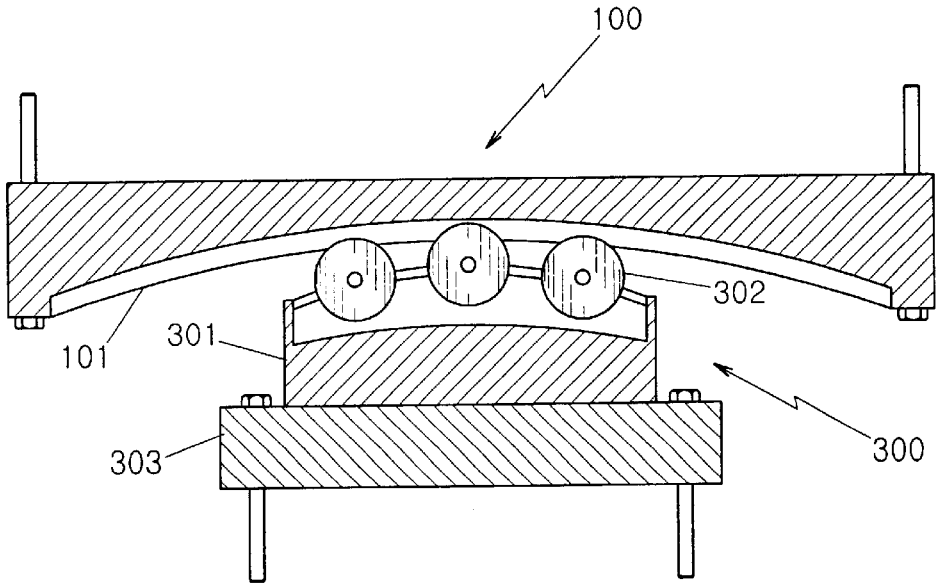
Figure 23A:
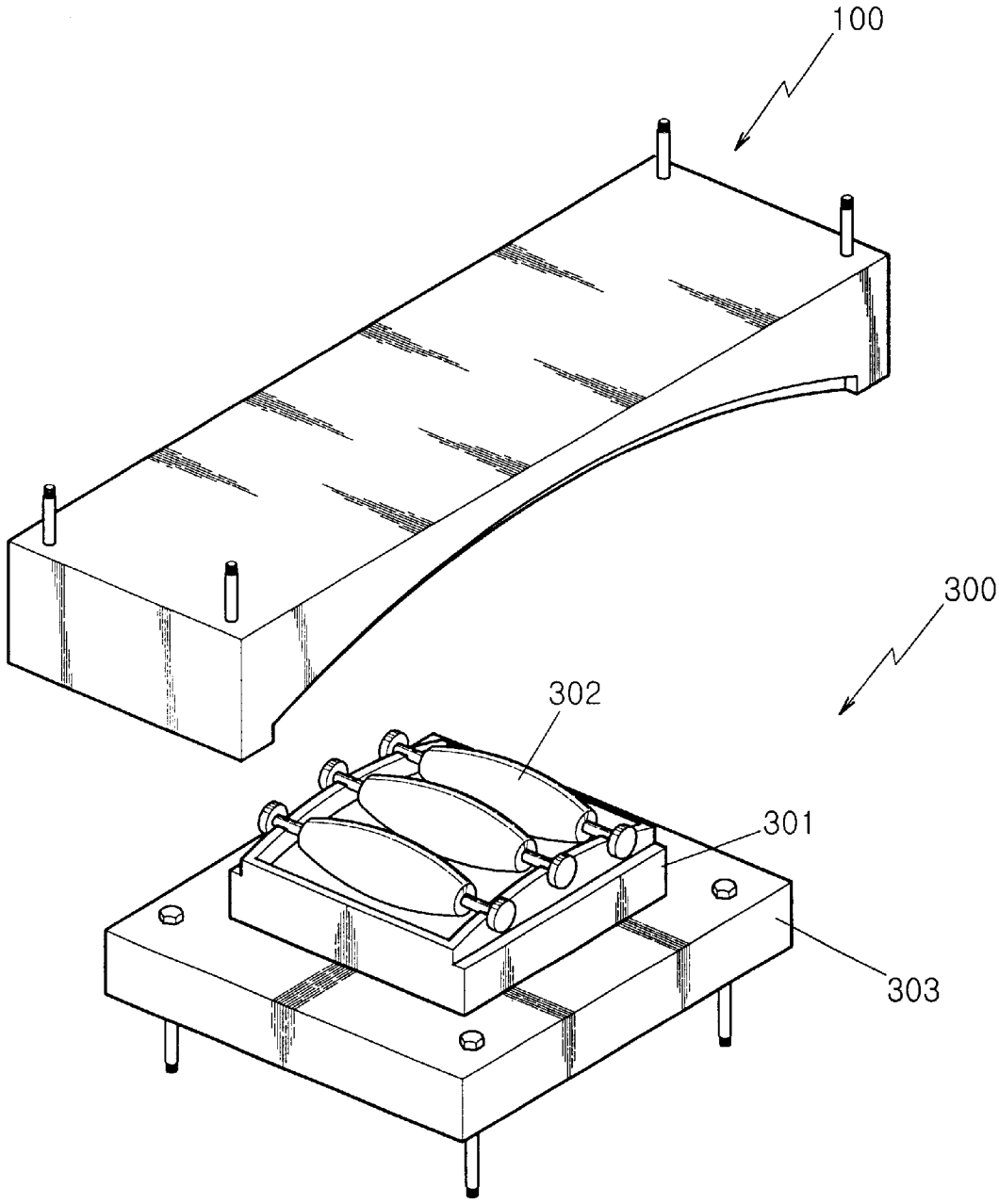
FIGS. 23*a* through 23*c* are perspective views and a sectional view of an uni-directional rolling pendulum seismic isolation system having one-channel plate.
Figure 23B:
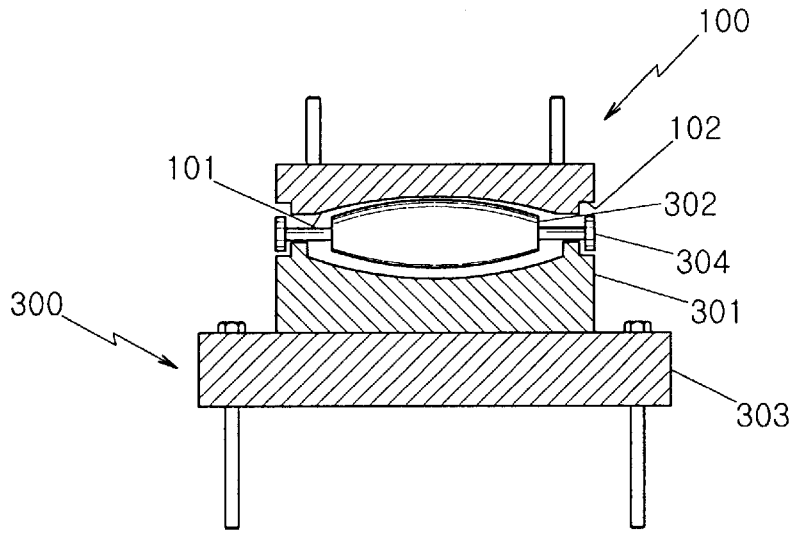
Figure 23C:
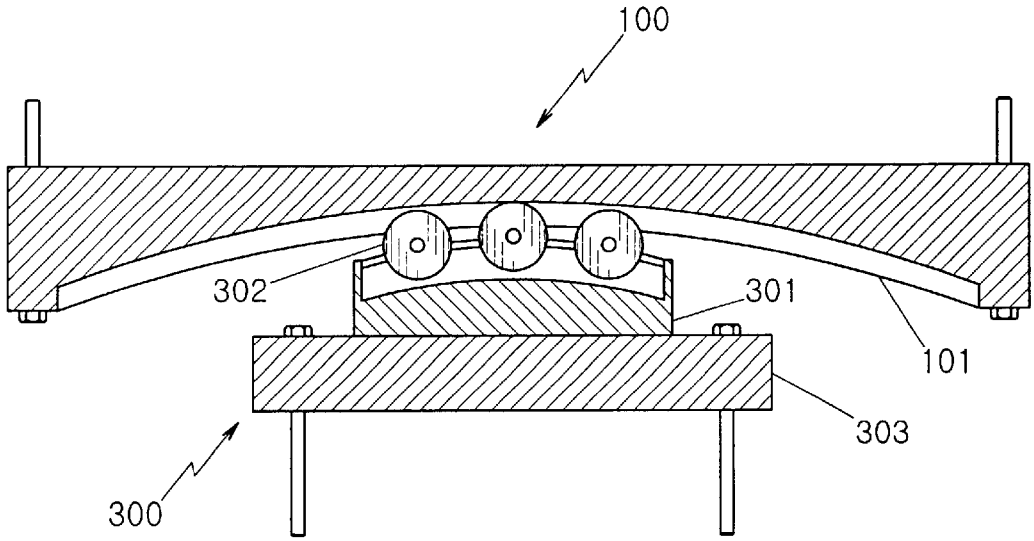

The uni-directional rolling pendulum seismic isolation systems according to the present invention can be manufactured in a separable manner to have an independent seismic isolation effect by direction. FIGS. 22*a* through 22*c* illustrate the uni-directional rolling pendulum seismic isolation systems having two-channel friction plates according to the present invention. FIGS. 23*a* through 23*c* illustrate an uni-directional rolling pendulum seismic isolation systems having one-channel friction plate according to the present invention. FIGS. 22*a* and 23*a* illustrate exploded perspective views of a friction plate 100 and a roller assembly 300 respectively. FIGS. 22*b* and 23*b* illustrate cross sectional views of the seismic isolation systems, and FIGS. 22*c* and 23*c* illustrate longitudinal cross sectional views of the seismic isolation systems.

The uni-directional pendulum seismic isolation systems according to the present invention includes a friction plate 100 having a friction channel 101 forming a uni-directional sliding way, and a roller assembly 300 rolling and performing the pendulum motion along the friction channel 101.

The friction plate 100 provided to the uni-directional rolling pendulum seismic isolation systems has the same structure as the upper and lower plates 10 and 20 provided to the bi-directional rolling pendulum seismic isolation systems.

The roller assembly 300 includes a main body 301, a plurality of rollers 302 arranged on an upper surface of the main body 301 and rolling and moving along the friction channel 101 of the friction plate 100, and a base plate 303 supporting the main body 301 and fixed to a pier or a foundation of a structure. The main body 301 may be manufactured integrally with the base plate 303 to move together. Alternatively, the main body may be separated from the base plate 303, thereby being formed in a separable type having the elastic or elasto-plastic objects like the bi-directional rolling pendulum seismic isolation systems. The elastic or elasto-plastic objects allow the main body 301 to perform the rotational motion on the horizontal axis and cause a vertical seismic isolation effect. If the main body 301 and the base plate 303 are manufactured in the separable form, the elastic or elasto-plastic objects may be provided between the main body 301 and the base plate 303 like in the case of the separable roller assembly of the bi-directional rolling pendulum seismic isolation systems. Because the structure of the elastic or elasto-plastic objects is the same as the separable roller assembly of the bi-directional rolling pendulum seismic isolation systems, its description will be omitted. As prescribed above, in the uni-directional rolling pendulum seismic isolation systems, the main body 301 can freely rotate on the horizontal axis relative to the base plate 303 because the main body and the base plate of the roller assembly can be manufactured in the separable type. Therefore, as prescribed above, the plurality of rollers can be contacted with the channel at the same time, and thereby the vertical load can be shared by the rollers and the motion of the rollers will be smooth.

The operation of the unidirectional rolling pendulum seismic isolation systems is the same as the one-direction rolling pendulum seismic isolation systems of the bi-directional rolling pendulum seismic isolation systems, and therefore, its description will be omitted.

Figure 24A:
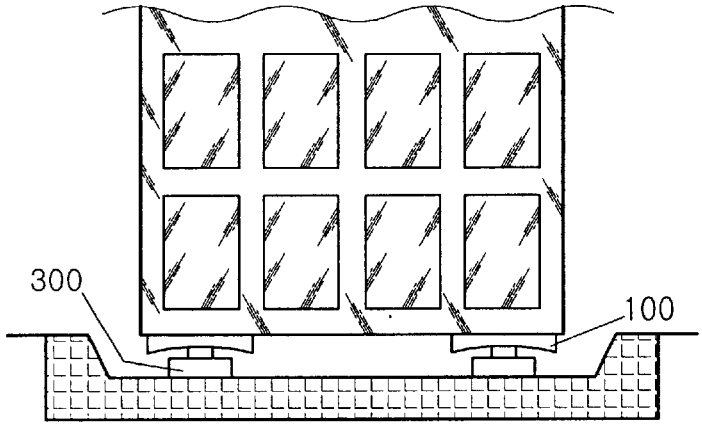
FIGS. 24*a* and 24*b* are brief views showing a state that the uni-directional rolling pendulum seismic isolation system is mounted on a structure.
Figure 24B:
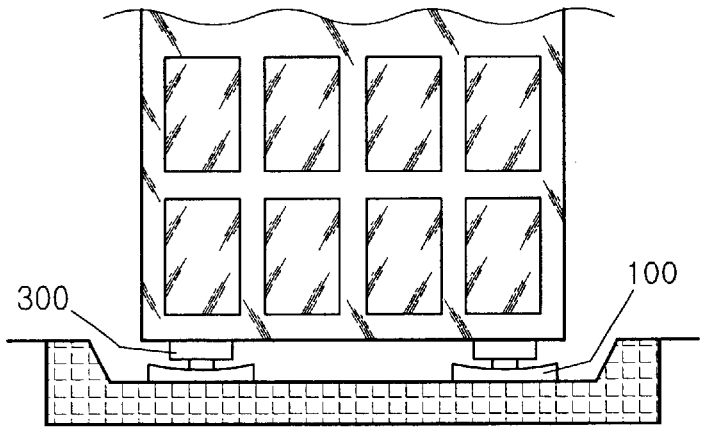

As shown in FIGS. 24*a* and 24*b*, the uni-directional rolling pendulum seismic isolation systems may be used in structures requiring a uni-directional seismic isolation.

FIG. 24*a* shows a state that the friction plate 100 is mounted on the structure and the roller assembly 300 is mounted on the foundation. FIG. 24*b* shows a state that the friction plate 100 is mounted on the foundation and the roller assembly 300 is mounted on the structure.

Figure 25A:
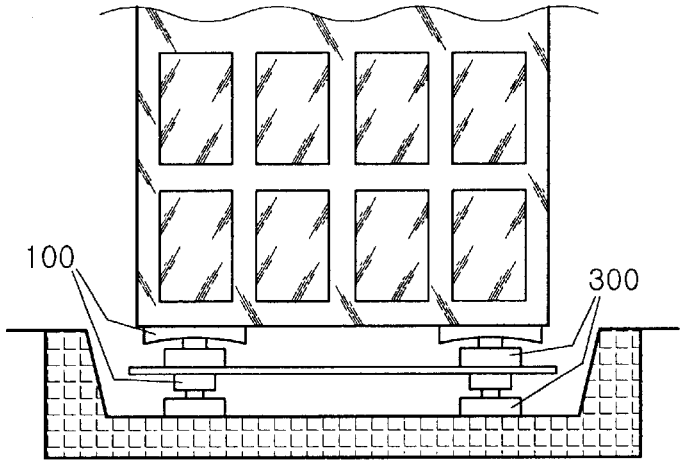
FIGS. 25*a* and 25*b* are brief views showing a state that the uni-directional rolling pendulum seismic isolation system is mounted on the structure in multi-layers.
Figure 25B:
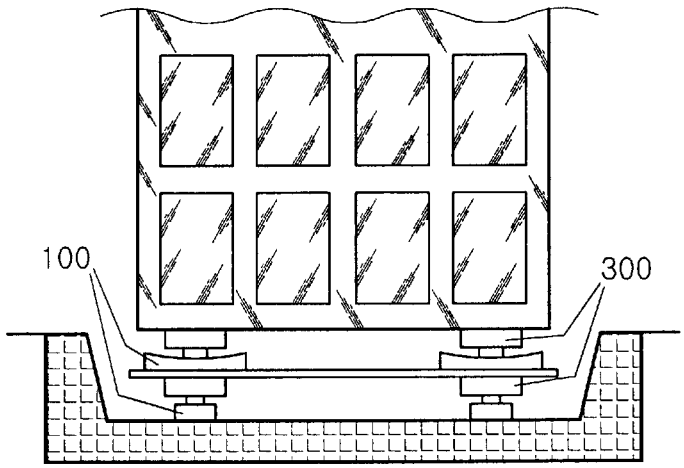

Meanwhile, the unidirectional rolling pendulum seismic isolation systems may be used even when a multi-directional seismic isolation is required. As shown in FIGS. 25*a* and 25*b*, the uni-directional rolling pendulum seismic isolation systems are installed in multi-layers. The seismic isolation systems are installed in such a manner that the roller assembly 300 rolls on a lower layer in a first direction and another roller assembly 300 rolls on an upper layer in a second direction. Like the above, if the uni-directional rolling pendulum seismic isolation systems are installed in the multi-layers, the seismic isolation effect of all horizontal directions can be obtained according to the rolling and movement of the roller assemblies in the first and second directions.

In FIG. 25*a*, the friction plate 100 is mounted on the structure and the lower surface of the multi layer plate and the roller assemblies are mounted on the foundation and the upper surface of the multi layer plate, but they may be mounted to the contrary.

As described above, by using the rollers instead of sliders, which are used in the conventional pendulum bearing or friction channel seismic isolation systems, using the point that a rolling friction resistance is lower than a sliding friction resistance, the friction coefficient can be maintained low. Therefore, the present invention can protect the structures, such as precision machines or cultural assets, from the seismic load. Because the rollers are used instead of the sliders, the performance can be maintained only with the minimum maintenance.

Compared with the conventional disc type pendulum seismic isolation systems, because the rolling pendulum of the present invention uses separated friction plates of two axial directions, the rolling pendulum suitable for the structures of a long seismic isolating period can be easily mounted in spite of a narrow installation space.

Furthermore, the isolating period may be freely selected in two axial directions, the seismic isolation systems can be freely designed to be suitable for dynamic characteristics even in the case of structures having different elasticity and geometric structure in two axial directions. Additionally, even after the seismic load has passed, the present invention always maintains an initial direction of the structure, so that the apparatus does not require restoration.

The rollers according to the present invention can have a stable structure by maintaining the smooth contact with the friction plates in spite of a construction error or severe temperature change because the drums have the curvature in the axial direction.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A bi-directional rolling pendulum seismic isolation system for reducing seismic force acting on a structure by rolling pendulum movements, said system comprising:

a lower plate forming a rolling path in a first direction;

an upper plate forming a rolling path in a second direction;

a roller assembly adapted to perform a pendulum motion by rolling and moving along the lower and upper plates, wherein the roller assembly performs the pendulum motion when seismic load is applied, thereby reducing the seismic load of a structure;

wherein each of said upper and lower plates has upper and lower channels on which said roller assembly rolls and moves, respectively;

wherein said roller assembly includes a lower main body on which a plurality of lower rollers are mounted on a lower portion thereof and an upper main body on which a plurality of upper rollers are mounted on an upper portion thereof, the lower rollers are adapted to roll and move along the lower channel of said lower plate provided on said bi-directional rolling pendulum seismic isolation system, the upper rollers are adapted to roll and move along the upper channel of said upper plate provided on said bi-directional rolling pendulum seismic isolation system;

wherein an intermediate main body is inserted between the upper main body and the lower main body, the upper main body and the lower main body are rotated relative to the intermediate main body around a horizontal direction respectively, and then said roller assembly is articulated;

wherein said upper and lower rollers are provided with auxiliary drums at both side ends respectively; and wherein said upper and lower plates are respectively provided with auxiliary channels at both sides for inserting the auxiliary drums, the auxiliary channels preventing the rollers from being separated from the channels when said upper and lower rollers of said roller assembly roll along the channels.

2. A system according to claim 1 wherein said roller assembly has a prescribed ratio of breath/height (B/H) to prevent an overturn when performing the pendulum motion, and wherein a radius of curvature ($r_L$) of a circular section of said upper channel is smaller than that of the first directional pendulum motion to prevent said upper rollers from being separated from said upper channel while said roller assembly performs the pendulum motion in said lower channel, and a radius of curvature ($r_T$) of a circular section of said lower channel is smaller than that of the second directional pendulum motion to prevent said lower rollers from being separated from said lower channel while said roller assembly performs the pendulum motion in said upper channel, and thereby performing a stable seismic isolation function without overturn or separation from said lower channel or said upper channel while said roller assembly performs the bi-directional pendulum motion.

3. A system according to claim 1 wherein said upper main body of the articulated roller assembly has a half-cylindrical hole formed on a lower surface thereof parallel to a direction of upper roller shafts and said lower main body has a half-cylindrical hole formed on an upper surface thereof parallel to a direction of lower roller shafts, and wherein said intermediate main body has a half-cylindrical projection formed on an upper surface thereof parallel to the direction of said upper roller shafts and a half-cylindrical projection formed on a lower surface thereof parallel to the direction of said lower roller shafts, and thereby said upper and lower main bodies freely rotate around the horizontal axis relative to the intermediate main body.

4. A system according to claim 1 wherein said upper main body of the articulated roller assembly has a half-cylindrical projection formed on a lower surface thereof parallel to a direction of upper roller shafts and said lower main body has a half-cylindrical projection formed on an upper surface thereof parallel to a direction of lower roller shafts, and wherein said intermediate main body has a half-cylindrical hole formed on an upper surface thereof parallel to the direction of the upper roller shafts and a half-cylindrical hole formed on a lower surface thereof parallel to the direction of the lower roller shafts, and thereby said upper and lower main bodies freely rotate around the horizontal axis relative to said intermediate main body.

5. A roller assembly mounted on a bi-directional rolling pendulum seismic isolation system and performing a pendulum motion according to seismic load applied to the roller assembly, the roller assembly comprising:

a lower main body having a plurality of lower rollers mounted on a lower portion thereof;

an upper main body having a plurality of upper rollers mounted on an upper portion thereof;

an intermediate main body being inserted between the upper main body and the lower main body;

wherein the lower rollers are adapted to roll and move along lower channels of a lower plate provided on the bi-directional rolling pendulum seismic isolation system, and the upper rollers are adapted to roll and move along upper channels of an upper plate provided on the bi-directional rolling pendulum seismic isolation system; and wherein the upper main body and the lower main body are rotated relative to the intermediate main body around a horizontal direction respectively, and thereby said roller assembly is articulated;

wherein said upper and lower rollers are provided with auxiliary drums at both side ends respectively; and wherein said upper and lower plates are respectively proved with auxiliary channels at both sides for inserting the auxiliary drums, the auxiliary channels preventing the rollers from being separated from the channels when said upper and lower rollers of said roller assembly roll along the channels.

6. The roller assembly according to claim 5 wherein said upper main body has a half-cylindrical hole formed on a lower surface thereof parallel to a direction of upper roller shafts and the lower main body has a half-cylindrical hole formed on an upper surface thereof parallel to a direction of lower roller shafts, and wherein an intermediate main body has a half-cylindrical projection formed on an upper surface thereof parallel to the direction of the upper roller shafts and a half-cylindrical projection formed on a lower surface thereof parallel to the direction of the lower roller shafts, and thereby said roller assembly is articulated and which said upper and lower main bodies freely rotate around the horizontal axis relative to said intermediate main body.

7. The roller assembly according to claim 5 wherein said upper main body has a half-cylindrical projection formed on a lower surface thereof parallel to a direction of upper roller shafts and the lower main body has a half-cylindrical projection formed on an upper surface thereof parallel to a direction of lower roller shafts; and wherein the intermediate main body has a half-cylindrical hole formed on an upper surface thereof parallel to the direction of the upper roller shafts and a half-cylindrical hole formed on a lower surface thereof parallel to the direction of the lower roller shafts, and thereby the upper and lower main bodies freely rotate around the horizontal axis relative to said intermediate main body.

* * * * *